US005594486A

United States Patent [19]

Kiyohara

[11] Patent Number: 5,594,486

[45] Date of Patent: Jan. 14, 1997

[54] SHEET CONVEY APPARATUS

[75] Inventor: Takehiko Kiyohara, Zama, Japan

[73] Assignee: Canon Kabushiki Kaisha, Tokyo, Japan

[21] Appl. No.: 611,015

[22] Filed: Mar. 5, 1996

Related U.S. Application Data

[63] Continuation of Ser. No. 174,008, Dec. 28, 1993, abandoned.

[30] Foreign Application Priority Data

Dec. 28, 1992 [JP] Japan ..... 4-361209
May 7, 1993 [JP] Japan ..... 5-106825

[51] Int. Cl.[6] ..... B41J 2/01; B65H 3/06

[52] U.S. Cl. ..... 347/104; 346/134; 271/274; 400/630; 400/636; 400/636.2

[58] Field of Search ..... 347/104; 346/134; 271/242, 272, 273, 274; 400/630, 636, 636.2

[56] References Cited

U.S. PATENT DOCUMENTS

| | | | |
|---|---|---|---|
| 3,240,487 | 3/1966 | Templeton | 271/53 |
| 4,248,415 | 2/1981 | Steinhilber | 271/9 |
| 4,990,011 | 2/1991 | Underwood et al. | 271/242 |
| 5,160,128 | 11/1992 | Oishi | 271/114 |
| 5,222,724 | 6/1993 | Hirano et al. | 271/242 |
| 5,238,235 | 8/1993 | Nitta et al. . | |

FOREIGN PATENT DOCUMENTS

| | | | |
|---|---|---|---|
| 487923 | 6/1992 | European Pat. Off. | B41J 13/00 |
| 57-189951 | 11/1982 | Japan | B65H 9/14 |
| 62-3826 | 1/1987 | Japan . | |
| 62-38261 | 8/1987 | Japan | B65H 9/14 |
| WOA19202441 | 2/1992 | WIPO | B65H 3/06 |

*Primary Examiner*—Valerie A. Lund
*Attorney, Agent, or Firm*—Fitzpatrick, Cella, Harper & Scinto

[57] ABSTRACT

The present invention provides a recording apparatus comprising convey means for conveying a sheet in a predetermined convey direction, a pair of rollers arranged downstream of the coney means in the convey direction for conveying the sheet in the convey direction or in a reverse direction by rotation in a forward direction or in a reverse direction, and control means for controlling the convey means and the pair of rollers. The control means controls these elements in such a manner that, after a sheet conveyed by the convey means is conveyed in the convey direction by a predetermined amount by the pair of rollers, the pair of rollers are rotated in the reverse direction while applying a conveying force in the convey direction to the sheet using the convey means, thereby conveying the sheet in the reverse direction until the sheet passes through a nip formed between the pair of rollers.

24 Claims, 20 Drawing Sheets

SHEET CONVEY APPARATUS

This application is a continuation of application Ser. No. 08/174,008, filed Dec. 28, 1993, now abandoned.

BACKGROUND OF THE INVENTION

1. Field of the Invention

The present invention relates to a sheet convey apparatus for conveying a sheet to a recording portion or a reading portion in a printer, a typewriter, a copying machine, a facsimile machine and the like, and more particularly, it relates to a sheet convey apparatus wherein a sheet can be fed in a direction perpendicular to a generatrix of a convey roller without skew-feed of the sheet and with high accuracy.

2. Related Background Art

As shown in FIG. 27, in a conventional recording apparatus 250, when a sheet P is set, the sheet P is rested on an inclined sheet supply tray 251, and then a knob 252 is rotated to wind the sheet P around a platen 253 once, and then the knob 252 is rotated reversely to disengage the sheet P from a nip between the platen 253 and a pinch roller 255. As a result, a leading or tip end of the sheet P is abutted against the nip between the platen 253 and the pinch roller 255 by the weight of the sheet, thereby positioning the sheet along the nip. Then, when the platen 253 is rotated normally, the sheet P is reliably conveyed in a direction perpendicular to the generatrix of the platen 253. The above method usually is used in conventional techniques.

However, in the conventional case shown in FIG. 27, after the sheet P is positioned along the nip between the platen 253 and the pinch roller 255, when the sheet is re-entered into the nip by rotating the knob 252 normally, since the urging force for abutting the tip end of the sheet P against the nip depends upon the weight of the sheet P itself, if a sheet supply direction becomes a direction near a horizontal direction, the urging force for abutting the sheet P against the nip is extremely weakened or eliminated, with the result that the sheet P cannot be re-entered into the nip.

Next, in the Japanese Patent Publication No. 62-38261, as shown in FIG. 28, a sheet P supplied from a pick-up roller 261 of a sheet supply device to a drive roller 262 is fed reversely until a tip end of the sheet passes through a nip of the drive roller 262, thereby forming a loop in the sheet P between the pickup roller 261 and the drive roller 262, so that the tip end of the sheet P is abutted against the nip of the drive roller 262. Thereafter, the sheet P is fed out by rotating the drive roller normally.

In the conventional case shown in FIG. 28, the urging force for abutting the tip end of the sheet against the nip of the drive roller 262 is not influenced by the sheet supply direction since such urging force depends upon the repelling force of the sheet P for restoring the looped sheet to its original flat form. However, since a loop must be formed in the rigid sheet P, a thick sheet cannot be used, and since a space and a convey path length sufficient to permit formation of the loop must be provided, it is difficult to make the apparatus small-sized.

SUMMARY OF THE INVENTION

An object of the present invention is to provide a sheet convey apparatus wherein a sheet can be conveyed correctly in a sheet supply direction even if an insertion direction for the sheet is skew and even when a thick sheet is supplied.

Another object of the present invention is to provide a sheet convey apparatus wherein a plurality of sheets (which are one of various kinds of sheets such as a thin sheet, thick sheet, post card, envelope, resin film or the like) can be separated one by one, and each separated sheet is passed through a main roller in a condition that a tip end of the separated sheet is positioned along the generatrix of the main roller, and the sheet is conveyed to a predetermined position with high accuracy (Incidentally, in the conventional techniques, since the usable sheets are limited to flexible ones, the kinds of the sheets are limited).

Another object of the present invention is to provide a sheet convey apparatus which can be made small-sized by reducing the large space and convey path length required for forming a loop in a sheet in the conventional techniques.

DETAILED DESCRIPTION OF THE PREFERRED EMBODIMENTS

Figure 1:
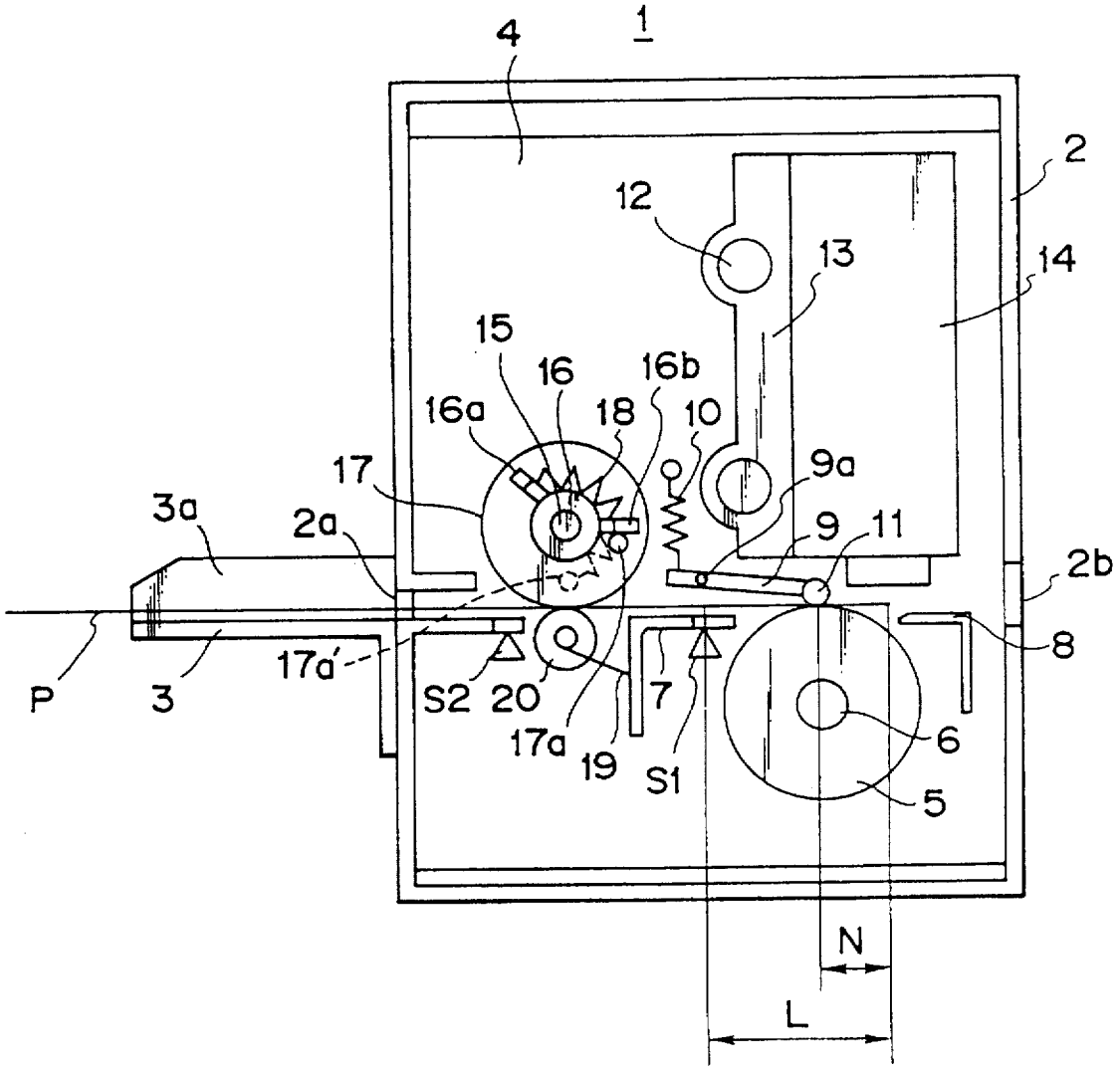
FIG. 1 is a longitudinal side sectional view of a recording apparatus to which a first embodiment (sheet convey apparatus) of the present invention is applied.
Figure 2:
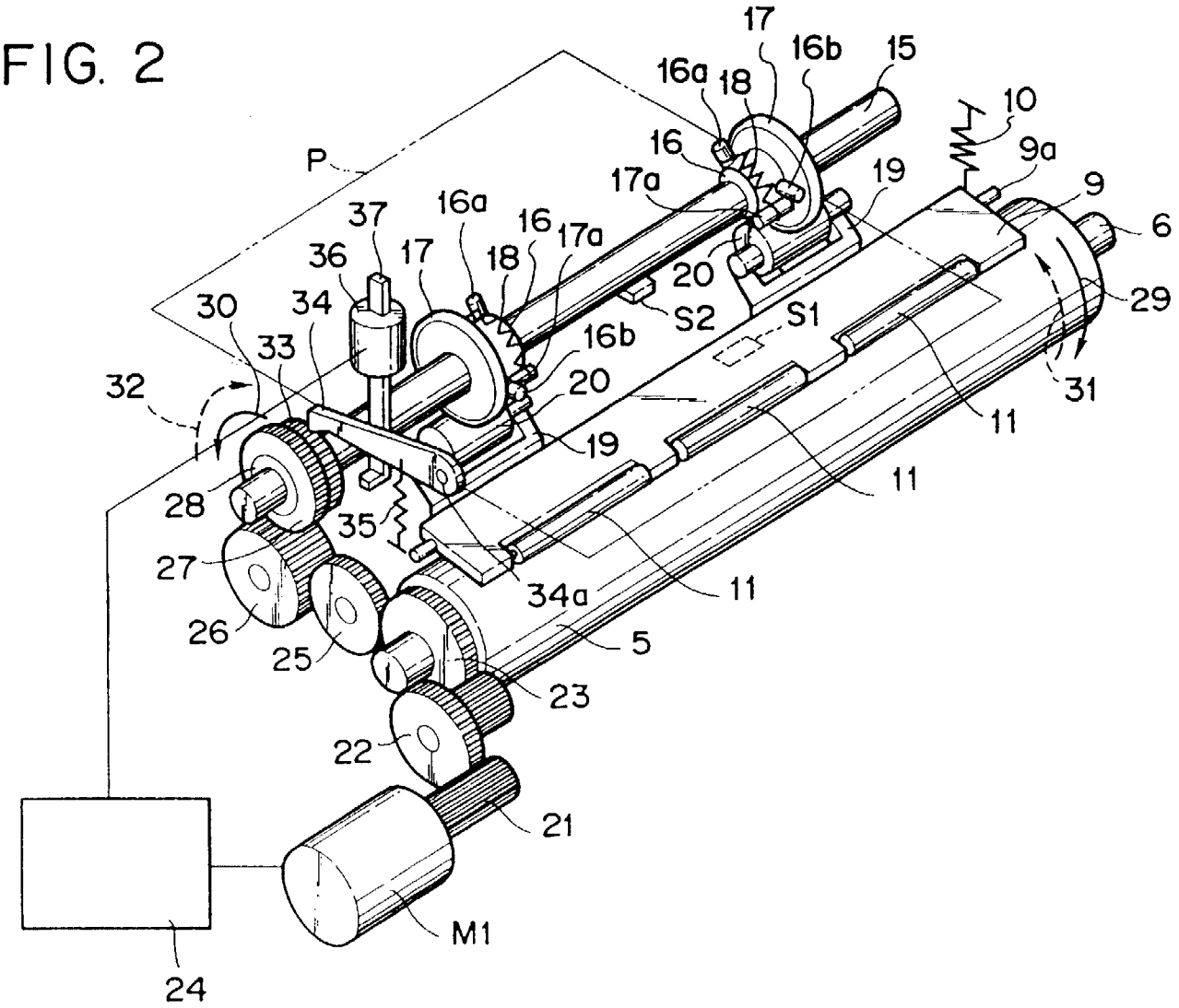
FIG. 2 is a perspective view of the sheet convey apparatus.

FIGS. 1 and 2 show a first embodiment of the present invention, where FIG. 1 is a sectional view of a recording apparatus including a sheet convey apparatus according to the first embodiment, and FIG. 2 is a perspective view of a sheet convey mechanism of the recording apparatus.

In FIG. 1, a recording apparatus 1 comprises an outer cover 2 and a sheet supply deck 3, and the cover 2 is provided with a sheet supply opening 2*a* and a sheet discharge opening 2*b*, and the sheet supply deck 3 is provided with a paper guide 3*a*. A sheet P is inserted from the sheet supply opening 2*a* and is discharged from the discharge opening 2*b*.

Inside a plurality of side plates 4 of the recording apparatus 1, there are arranged a main roller 5 for conveying the sheet, a support shaft 6 on which the main roller 5 is secured, a guide plate 7 for guiding the sheet, a sensor S1 disposed in an opening formed in the guide plate 7, a platen 8 for establishing a print position for the sheet, a hold-down plate 9 pivotally mounted around a fulcrum 9*a* and biased by a spring 10 toward the main roller 5, hold-down rollers 11 rotatably mounted on a free end portion of the hold-down plate 9 and adapted to urge the sheet against the main roller 5, a carriage 13 shiftable along a plurality of guide shafts 12 in a widthwise direction of the sheet, and a recording head 14 mounted on the carriage 13 and adapted to perform printing in response to image information.

In place of the hold-down rollers 11 mounted on the free end of the hold-down plate 9, the free end itself of the hold-down plate 9 may be used as a means for urging the sheet against the main roller 5. Further, in this case (having no hold-down roller), the hold-down plate may be formed from a thin plate having the spring feature such as stainless steel.

Further, within the recording apparatus 1, there are arranged a support shaft 15, a ring 16 secured to the support shaft 15, pins 16*a*, 16*b* protruded from a peripheral surface of the ring 16, auxiliary rollers 17 rotatably supported by the support shaft 15 and having a pin 17*a* at its side surface, a spring 18 extending between the pins 16*a* and 17*a*, a pinch roller 20 rotatably supported by a spring plate 19 and urged against the auxiliary rollers 17, and a sensor S2 disposed in the proximity of the sheet supply opening 2*a*. A peripheral surface of the auxiliary roller 17 is constituted by high friction material such as rubber.

In FIG. 2, a motor M1 serves to rotate the main roller 5 via a motor gear 21, a two-stage gear 22 and a main roller gear 23 secured to the shaft 6 in response to a control signal from a controller (control device) 24. A rotational force of the motor M1 is transmitted to the shaft 15 via a gear 25 meshed with the main roller gear 23, a gear 26 and a one-way clutch 28.

The one-way clutch 28 can transmit forward rotation (in a direction shown by the arrow 30) of a gear 27 in response to forward rotation of the main roller 5 in a direction shown by the arrow 29 (normal convey direction for the sheet P) to the shaft 15, but does not transmit reverse rotation (in a direction shown by the arrow 32) of the gear 27 in response to reverse rotation of the main roller 5 in a direction shown by the arrow 31 (reverse convey direction for the sheet P) to the shaft 15. A tip end of a ratchet lever 34 mounted around a shaft 34*a* and biased by a biasing force of a spring 35 in an anti-clockwise direction is abutted against a peripheral surface of a ratchet wheel 33 secured to the support shaft 15 and having saw-shaped teeth on its peripheral surface. The ratchet lever 34 permits forward rotation of the ratchet wheel 33 in a direction shown by the arrow 30, but prevents reverse rotation of the ratchet wheel in a direction shown by the arrow 32.

When a movable bar 37 is shifted upwardly by a plunger 36 in response to a control signal from the controller 24, since the ratchet lever 34 contacted with a lower bent portion of the movable bar 37 is rotated in a clockwise direction in opposition to the force of the spring 35, the ratchet lever is disengaged from a tooth of a ratchet wheel 33, thereby permitting the clockwise rotation of the ratchet wheel 33.

Next, a sheet convey operation of the sheet convey apparatus according to the first embodiment will be explained with reference to FIGS. 1 and 2.

When a sheet P is inserted from the sheet supply opening 2*a* along the sheet supply deck 3 and paper guide 3*a*, a tip end of the sheet is detected by the sensor S1. On the basis of the detection of the sensor, the controller 24 energizes the motor M1 to rotate the main roller 5 in the normal sheet convey direction shown by the arrow 29.

The rotation of the main roller 5 is transmitted to the gear 27 (rotation in the direction shown by the arrow 30) via the gears 25, 26. When the gear 27 is rotated in the direction shown by the arrow 30, since the one-way clutch 28 connects gear 27 to the support shaft 15, the support shaft 15 is also rotated in the same direction. The rotation of the support shaft 15 is transmitted to the auxiliary rollers 17 via the ring 16 secured to the support shaft 15, the pin 16*a* protruded from the ring 16, the pin 17*a* formed on the side surface of the auxiliary rollers 17 and the spring 18 connecting between the pins 16*a*, 17*a*, thereby rotating the auxiliary rollers 17 in the direction shown by the arrow 30.

During the above rotation, the pin 17*a* is always abutted against the pin 16*b* with a predetermined force by the spring 18. By rotating the auxiliary rollers 17 in the direction shown by the arrow 30, the sheet P is conveyed toward that side of the apparatus; meanwhile, when the tip end of the sheet is detected by the sensor S1, the controller 24 controls the motor M1 to feed out the tip end of the sheet by a length L shown in FIG. 1. Now, a protruded amount N of the tip end of the sheet from the nip between the main roller 5 and the hold-down rollers 11 will now be explained with reference to FIG. 9, which is a plan view of the sheet convey portion of the recording apparatus of FIG. 1.

When a sheet P is skew-fed as shown by $P_1$, the protruded amount N at the left side differs from that at the right side, and there is the following difference W between the left protruded amount T and the right protruded amount U:

$$W=T-U$$

When it is assumed that the difference W is a skew amount, if the amount of the difference W is great, the protruded amount N must be increased accordingly; however, the protruded amount is limited due to the size of the sheet supply opening 2*a*.

The means 3*a*, 3*b* for regulating lateral edges of the sheet is effective to regulate the protruded amount difference W. When it is assumed that the protruded amount difference W is 3 mm and the margin of slip between the sheet P and the convey rollers is 2 mm, the protruded amount N becomes as follows:

$$N=3+2=5.$$

When the tip end of the sheet is protruded by the amount N, the main roller 5 is rotated in the sheet reverse convey direction shown by the arrow 31 under the control of the controller 24 (see FIG. 2). The rotational amount of the main roller 5 is greater than at least the protruded amount N, and, desirably, is (2×N)–(3×N).

In response to the rotation of the main roller 5 in the direction shown by the arrow 31, the gear 27 is rotated in the direction shown by the arrow 32. However, this rotation is not transmitted to the support shaft 15 by the action of the one-way clutch 28.

In synchronism with the reverse movement of the sheet P, the auxiliary rollers 17 are rotated in the direction shown by the arrow 32. On the other hand, although the pin 17*a* is also rotated, since the support shaft 15 cannot be rotated in the direction shown by the arrow 32 by the action of the ratchet wheel 33 and the ratchet lever 34, the pin 16*a* is not rotated, with the result that the rotation of the auxiliary rollers 17 results in only the extension of the spring 18. Since the tension force of the spring 18 acts to rotate the auxiliary rollers 17 in the direction shown by the arrow 30, during this action, the auxiliary rollers 17 always give a normal direction conveying force to the sheet. Further, since the plurality of auxiliary rollers 17 are rotatably mounted on the support shaft 15 so that they can be rotated independently, the auxiliary rollers 17 can be rotated independently even if the shifting amounts of the sheet differ from each other in the widthwise direction of the sheet.

Figure 9:
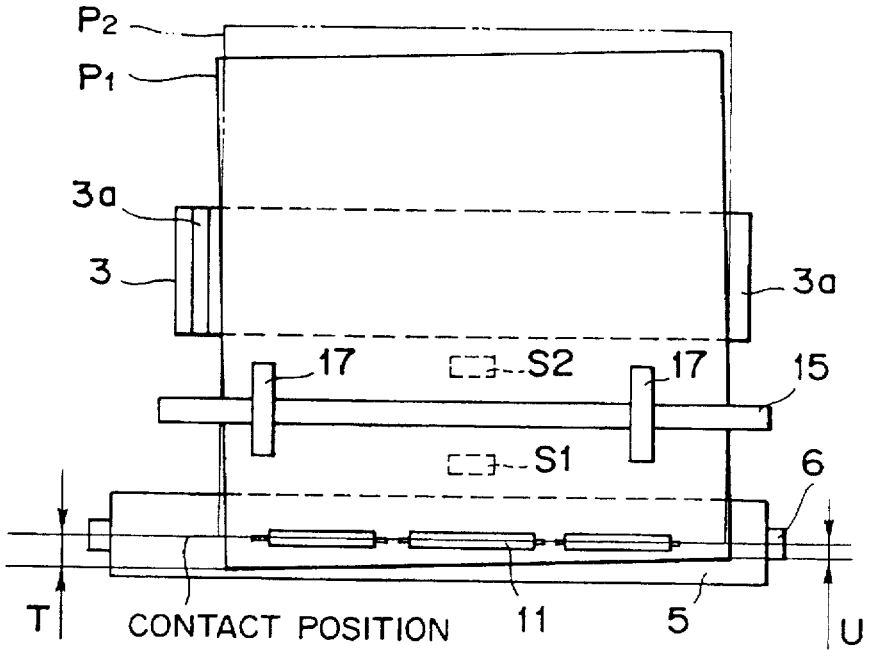
FIG. 9 is a plan view of a sheet and a sheet supply portion according to the present invention.

In FIG. 9, if a sheet P is conveyed reversely from the condition $P_1$, first of all, the right protruded amount U is conveyed to the nip (contact position) between the main roller 5 and the hold-down rollers 11, and when the right end passes through the contact position, the right end is not further shifted reversely. At the same time, although the left protruded amount T is conveyed to the nip, since U<T, the left end is conveyed to the contact position later than the right end. As a result, the right and left ends of the sheet P are stopped along the contact position to establish a condition $P_2$. The biasing force of the spring 18 is selected so that the tip end of the sheet is not flexed in the condition $P_2$. The condition $P_2$ is referred to as a sheet registration start position. From this condition, when the main roller 5 is rotated in the direction shown by the arrow 29 by a predetermined amount by the controller 24, by the normal direction conveying force of the auxiliary rollers 17, the left and right tip ends of the sheet P enter into the contact position along the contact position and then are conveyed to a record position of the recording head 14 without any skew-feed and with high accuracy.

Next, in response to a record signal, the sheet P is fed normally by a predetermined amount and then the carriage 13 is shifted reciprocally in the widthwise direction, thereby effecting one line recording by the recording head 14. By repeating such operations, one page recording of the sheet is effected. During the recording, when a special record mode is performed (for example, when the recording head 14 is returned to the previously recorded line and recording is effected again on that line), the controller 24 energizes the plunger 36 to permit the rotation of the ratchet wheel 33 in the direction shown by the arrow 32. At the same time, when the main roller 5 is rotated in the direction shown by the arrow 31 by a predetermined amount in order to return the sheet P to the previously recorded line, since the auxiliary rollers 17 do not generate the normal direction conveying force and are freely rotated by the reverse movement of the sheet P, the sheet P is returned with the convey accuracy of the main roller 5. Thereafter, when the main roller 5 is rotated normally again, the controller 24 stops the operation of the plunger, thus restoring the original condition.

As another method for controlling the plunger 36, when the sheet P reaches the record position of the recording head 14, the plunger 36 may be driven to lift the lever 34 and the plunger 36 may be stopped at the time when the recording operation is completed.

When a trailing end of the sheet P is detected by the sensor S1, the main roller 5 feeds the sheet by a predetermined amount for recording under the control of the controller 24. After the last feeding of the sheet is completed, the main roller 5 is rotated by a predetermined amount, thereby discharging the sheet from the discharge opening 2*b*.

When the whole sheet feeding amount for the recording previously stored on the basis of a command from a computer is completed, the controller 24 rotates the main roller 5 to discharge the sheet, even without the detection signal of the sensor S1 representative of the fact that the trailing end of the sheet is detected. After the sheet is discharged by the main roller 5, the controller 24 sets the recording apparatus 1 to the initial condition when the signal from the sensor S1 indicates the absence of a sheet. On the other hand, if the signal from the sensor indicates the presence of a sheet, the controller judges the fact that a poor sheet convey condition has occurred, and emits an alarm signal via display means or sound means.

Next, a second embodiment of the present invention will be explained with reference to FIGS. 3 and 4.

Figure 3:
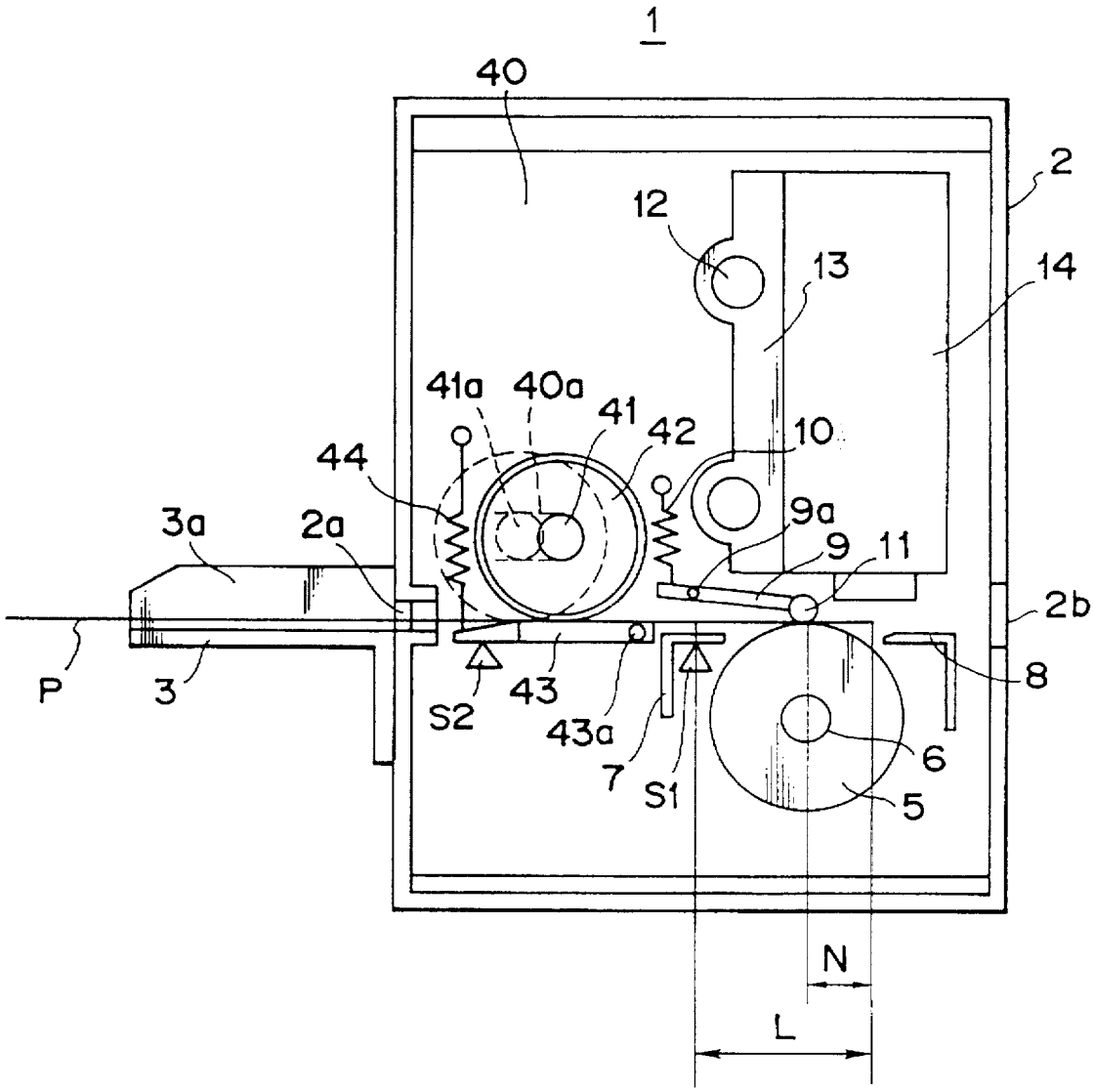
FIG. 3 is a longitudinal side sectional view of a recording apparatus to which a second embodiment (sheet convey apparatus) of the present invention is applied.
Figure 4:
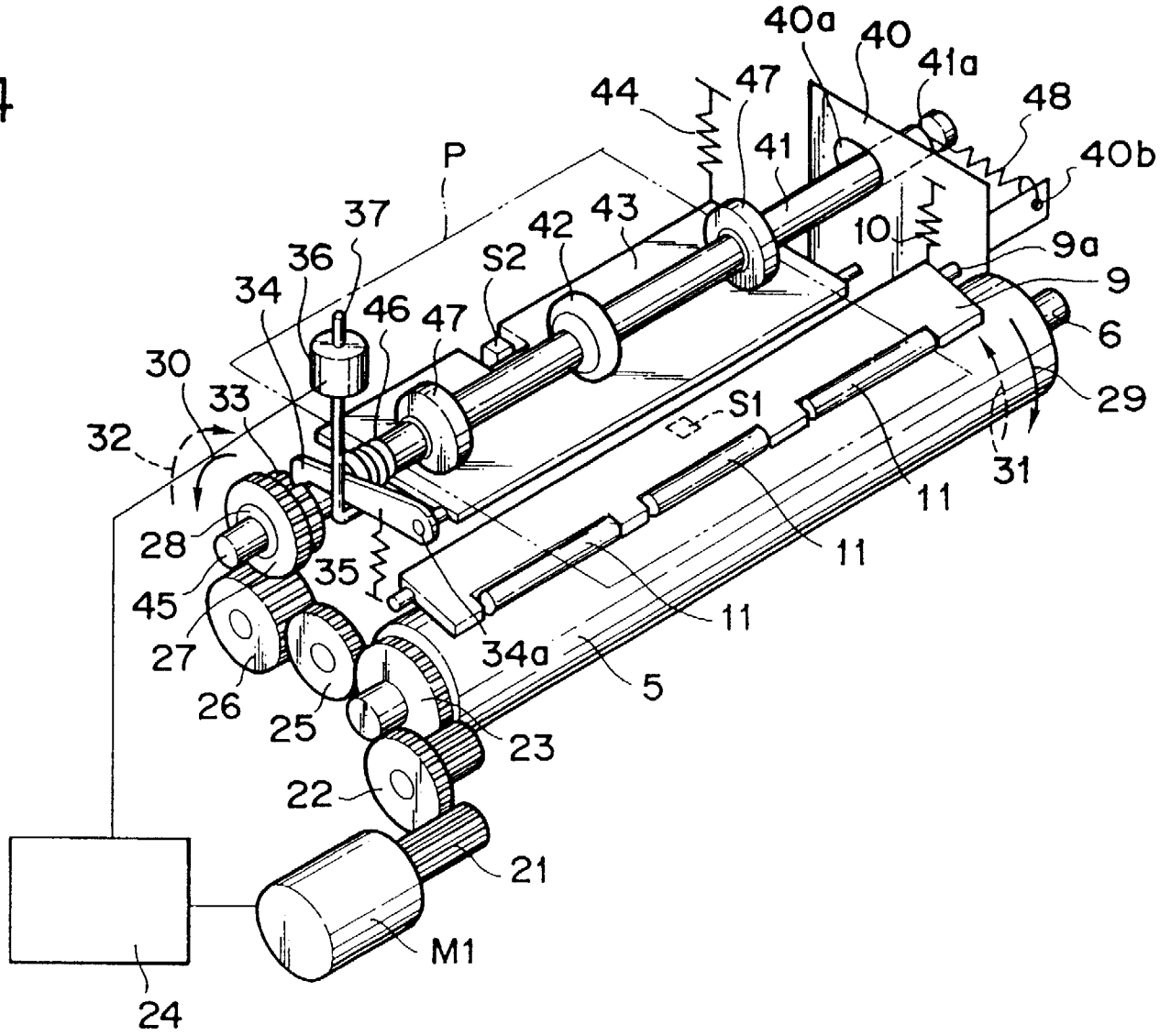
FIG. 4 is a perspective view of the sheet convey apparatus of FIG. 3.

FIG. 3 is a sectional view of a recording apparatus according to the second embodiment, and FIG. 4 is a schematic perspective view of a sheet convey mechanism of the recording apparatus. Incidentally, in FIGS. 3 and 4, the same structural and functional elements as those of FIGS. 1 and 2 are designated by the same reference numerals.

In FIG. 3, the recording apparatus 1 comprises an outer cover 2 and a sheet supply deck 3, and the cover 2 is provided with a sheet supply opening 2*a* and a sheet discharge opening 2*b*, and the sheet supply deck 3 is provided with a paper guide 3*a*. A sheet P is inserted from the sheet supply opening 2*a* and is discharged from the discharge opening 2*b*. Inside a plurality of side plates 40 of the recording apparatus 1, there are arranged a main roller 5 for conveying the sheet, a support shaft 6 on which the main roller 5 is secured, a guide plate 7 for guiding the sheet, a sensor S1 disposed in an opening formed in the guide plate, a platen 8 for establishing a record position for the sheet, a hold-down plate 9 pivotally mounted around a fulcrum 9*a* and biased by a spring 10 toward the main roller 5, hold-down rollers 11 rotatably mounted on a free end portion of the hold-down plate 9 and adapted to urge the sheet against the main roller 5, a carriage 13 shiftable along a plurality of guide shafts 12 in a widthwise direction of the sheet, and a recording head 14 mounted on the carriage 13 and adapted to perform printing in response to image information.

Further, within the recording apparatus 1, there are arranged a support shaft 41 received in slots 40*a* formed in the side plates 40 for movement to a position 41*a* shown by broken lines an auxiliary roller 17 secured to the support shaft 41 and having a peripheral surface constituted by high friction material such as rubber, a directing plate 43 rotatably supported around a support shaft 43*a* and biased by a spring 44 to be urged against the auxiliary roller 42 with a predetermined pressure and having an abutment surface formed from smooth material, and a sensor S2 disposed in an opening formed in the directing plate 43 and in the proximity of the sheet supply opening 2*a*.

In FIG. 4, a motor M1 serves to rotate the main roller 5 via a motor gear 21, a two-stage gear 22 and a main roller gear 23 secured to the shaft 6 in response to a control signal from a controller 24. A rotational force of the motor M1 is transmitted to the shaft 41 via a gear 25 meshed with the main roller gear 23, a gear 26 and a one-way clutch 28. The one-way clutch 28 can transmit forward rotation (in a direction shown by the arrow 30) of a gear 27 to a shaft 45, but does not transmit reverse rotation (in a direction shown by the arrow 32) of the gear 27 to the shaft 45.

The shaft 45 and the support shaft 41 are interconnected via a universal joint 46 which can be freely flexed and can transmit the rotation. Further, a plurality of free rollers 47 are rotatably mounted on the support shaft 41. A spring 48 having one end connected to one end 41*a* of the support shaft 41 and the other end connected to a hook portion 40*b* provided on the side plate 40 biases the support shaft 41 toward the main roller 5 along the slots 40*a*.

A tip end of a ratchet lever 34 mounted around a shaft 34*a* and biased by a biasing force of a spring 35 in an anti-clockwise direction is abutted against a peripheral surface of a ratchet wheel 33 secured to the support shaft 15 and having saw-shaped teeth on its peripheral surface. The ratchet lever 34 permits forward rotation of the ratchet wheel 33 in a direction shown by the arrow 30, but prevents reverse rotation of the ratchet wheel in a direction shown by the arrow 32.

When a movable bar 37 is shifted upwardly by a plunger 36 in response to a control signal from the controller 24, since the ratchet lever 34 contacted with a lower bent portion of the movable bar 37 is rotated in a clockwise direction around the shaft 43*a*, the ratchet lever is disengaged from the tooth of the ratchet wheel 33, thereby permitting rotation of the ratchet wheel 33 in the direction shown by the arrow 32.

Next, a sheet convey operation of the sheet convey apparatus according to the second embodiment will be explained with reference to FIGS. 3 and 4.

When a sheet P is inserted from the sheet supply opening 2*a* along the sheet supply deck 3 and paper guide 3*a*, a tip end of the sheet is detected by the sensor S1. On the basis of the detection of sensor S1, the controller 24 energizes the motor M1 to rotate the main roller 5 in the normal sheet convey direction shown by the arrow 29. The rotation of the main roller 5 is transmitted to the gear 27 via the gears 23, 25 and 26 to rotate the gear 27 in the direction shown by the arrow 30.

When the gear 27 is rotated in the direction shown by the arrow 30, since the one-way clutch 28 connects gear 27 to the shaft 45, the support shaft 41 is also rotated in the same direction 30 via the universal joint 46. The sheet P pinched between the auxiliary roller 42 secured to the support shaft 41 and the directing plate 43 is sent to the main roller 5 by the rotation of the auxiliary roller 42. The free rollers 47 follow the movement of the sheet P and guide the sheet P while holding down the sheet. When the tip end of the sheet P is detected by the sensor S1, the controller 24 controls the motor M1 to feed out the tip end of the sheet by a length L.

Then, when the controller 24 rotates the main roller 5 in the direction shown by the arrow 31 by a predetermined amount, the auxiliary roller 42 tries to rotate in the direction shown by the arrow 32 in response to the reverse movement of the sheet P, but the auxiliary roller cannot be rotated due to the action of the ratchet lever 34. Accordingly, the auxiliary roller 42 is shifted away from the roller 5 while being stopped and while extending the spring 48. During this shifting movement, the auxiliary roller 42 continues to apply a conveying force to the sheet P in the normal (forward) convey a direction with the aid of the extended spring 48.

During the reverse rotation of the main roller 5, when the left and right tip ends of the sheet P are passed by a nip (contact position) between the main roller 5 and the hold-down rollers 11, the left and right tip ends of the sheet P are maintained along the contact position by the shifting force of the auxiliary roller 42. The biasing force of the spring 48 is selected so that the tip end of the sheet is not flexed by the shifting force of the auxiliary roller.

After the predetermined amount of reverse rotation of the main roller 5, when the main roller 5 is rotated normally by a predetermined amount from the above condition which is referred to as a sheet registration start position, the left and right tip ends of the sheet P pass through the contact position along the contact position by the shifting force of the auxiliary roller 42 and are further conveyed to a record position of the recording head 14 without skew-feed and with high accuracy. Thereafter, since the operation from the recording to the discharge of the sheet is the same as the first embodiment, the explanation thereof will be omitted.

Next, a third embodiment of the present invention will be explained with reference to FIGS. 5 and 6.

Figure 5:
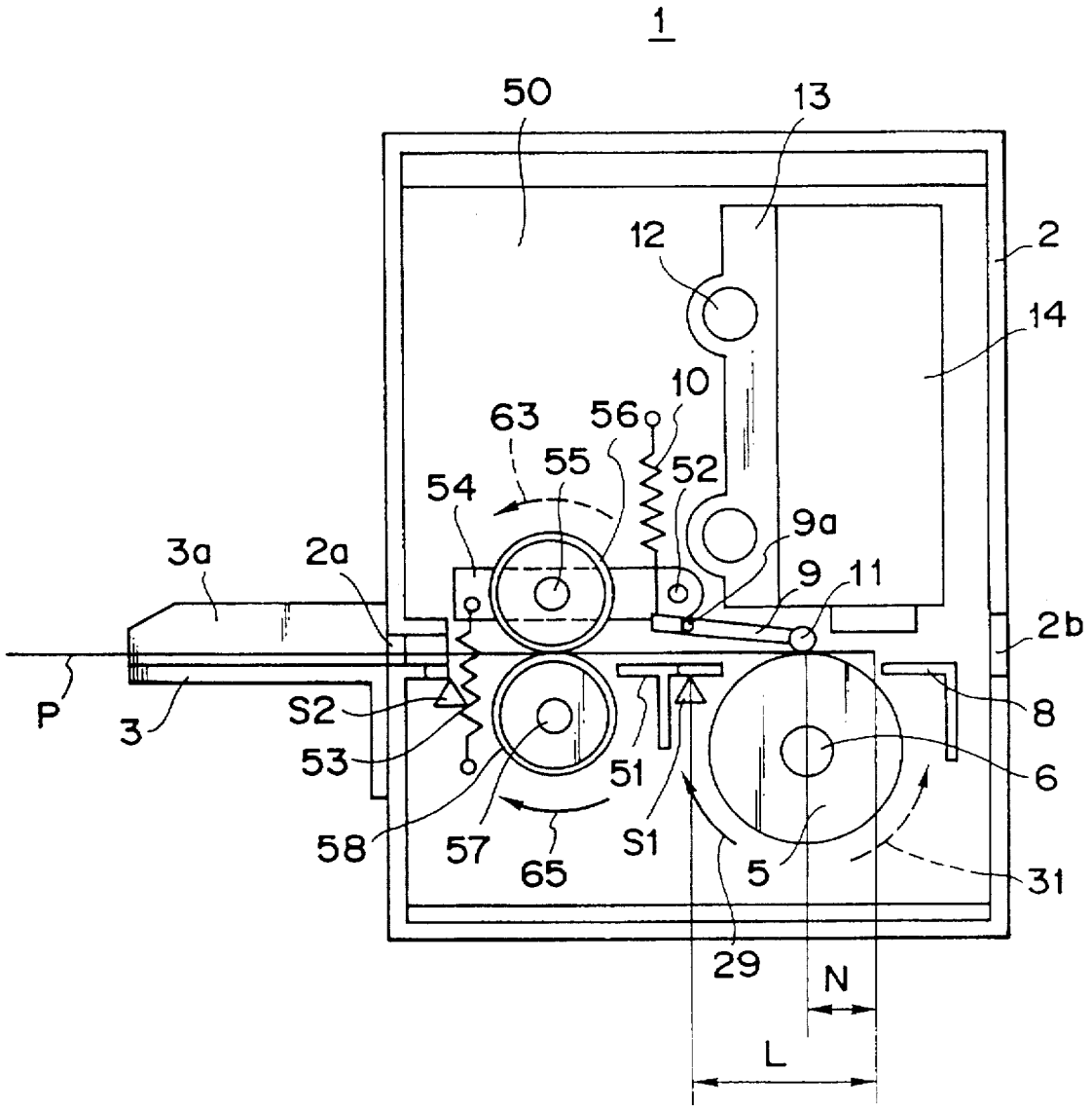
FIG. 5 is a longitudinal side sectional view of a recording apparatus to which a third embodiment (sheet convey apparatus) of the present invention is applied.
Figure 6:
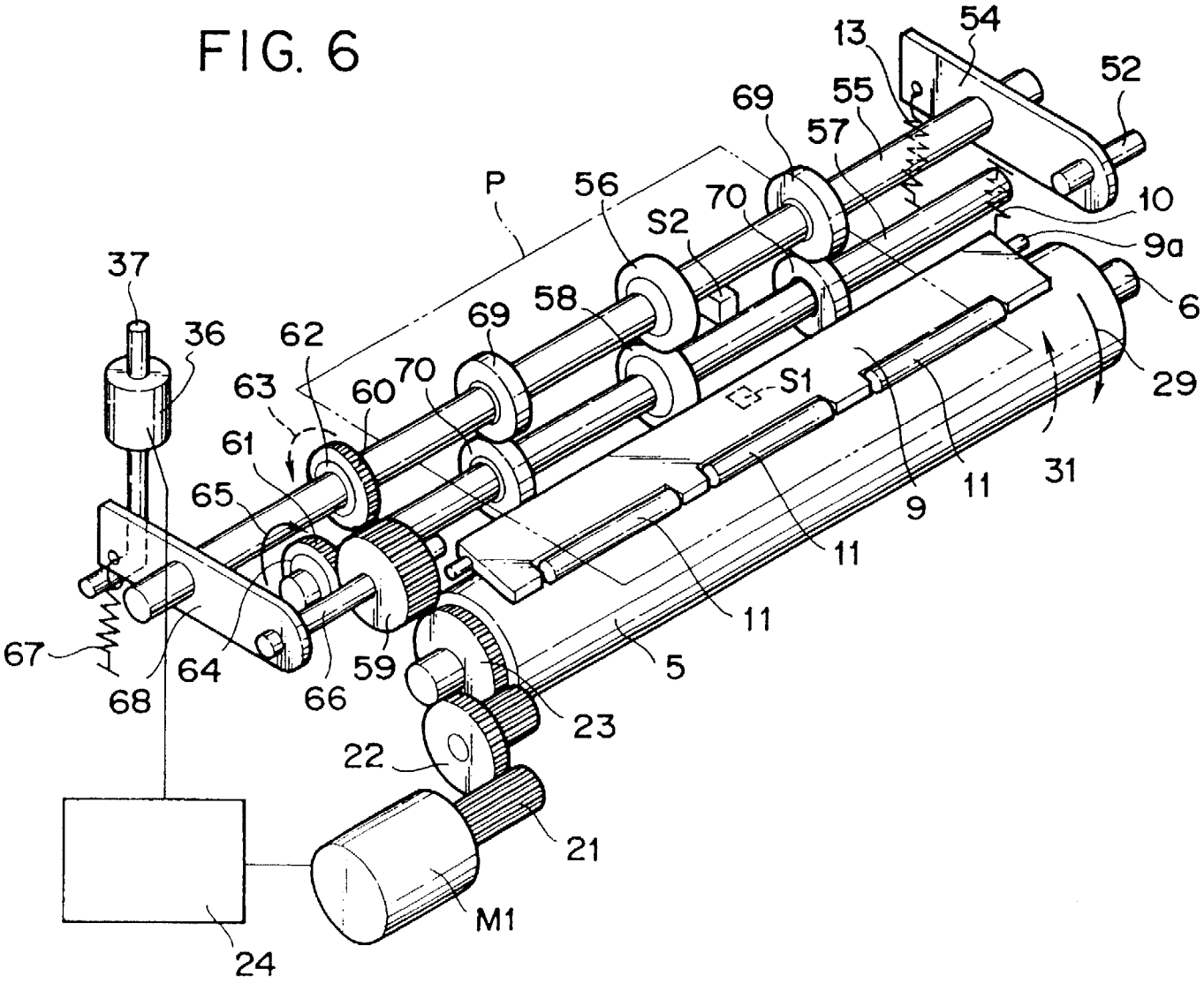
FIG. 6 is a perspective view of the sheet convey apparatus of FIG. 5.

FIG. 5 is a sectional view of a recording apparatus according to the third embodiment, and FIG. 6 is a schematic perspective view of a sheet convey mechanism of the recording apparatus. Incidentally, in FIGS. 5 and 6, the same structural and functional elements as those of FIGS. 1 and 2 are designated by the same reference numerals.

In FIG. 5, the recording apparatus 1 comprises an outer cover 2 and a sheet supply deck 3, and the cover 2 is provided with a sheet supply opening 2*a* and a sheet discharge opening 2*b*, and the sheet supply deck 3 is provided with a paper guide 3*a*. A sheet P is inserted from the sheet supply opening 2*a* and is discharged from the discharge opening 2*b*. Inside a plurality of side plates 50 of the recording apparatus 1, there are arranged a main roller 5 for conveying the sheet, a support shaft 6 on which the main roller 5 is secured, a guide member 51 for guiding the sheet, a sensor S1 disposed in an opening formed in the guide member 51, a platen 8 for establishing a record position for the sheet, a hold-down plate 9 pivotally mounted around a fulcrum 9*a* and biased by a spring 10 toward the main roller 5, hold-down rollers 11 rotatably mounted on a free end portion of the hold-down plate 9 and adapted to urge the sheet against the main roller 5, a carriage 13 shiftable along a plurality of guide shafts 12 in a widthwise direction of the sheet, and a recording head 14 mounted on the carriage 13 and adapted to perform printing in response to image information.

Further, within the recording apparatus 1, there are arranged a lever 54 rotatably mounted on a pin 52 and biased toward a clockwise direction by a biasing force of a spring 53, a shaft 55 on which one end of the lever 54 is pivotally mounted, an auxiliary roller 56 secured to the shaft 55, a shaft 57 having both ends rotatably supported by the side plates 50, an auxiliary roller 58 secured to the shaft 57, and a sensor S2 disposed in the proximity of the sheet supply opening 2*a*.

In FIG. 6, a motor M1 serves to rotate the main roller 5 via a motor gear 21, a two-stage gear 22 and a main roller gear 23 secured to the shaft 6 in response to a control signal from a controller 24. A rotational force of the motor M1 is transmitted to gears 60, 61 via a gear 59 meshed with the main roller gear 23. A one-way clutch 62 can transmit forward rotation (in a direction shown by the arrow 63) of the gear 60 to the shaft 55, but does not transmit reverse rotation (in the reverse direction) of the gear 60 to the shaft 55. A one-way clutch 64 can transmit forward rotation (in a direction shown by the arrow 65) of reverse 61 to the shaft 57, but does not transmit the rotation (in the reverse direction) of the gear 61 to the shaft 57.

Since the other end of the shaft 55 is rotatably supported by a lever 68 rotatably mounted on a shaft 66 of the gear 59 and biased in an anti-clockwise direction by a biasing force of a spring 67, a distance between the shafts of the gears 59, 60 is kept constant even when the levers 54, 68 are rotated.

When the main roller 5 is rotated in the direction shown by the arrow 29, the gear 64 is rotated in the direction shown by the arrow 65 via gears 23, 59. This rotation is transmitted to the shaft 57 via the one-way clutch 64, thereby rotating the auxiliary roller 58 in the direction shown by the arrow 65. On the other hand, since rotation of the gear 60 in the same rotational direction of the gear 64 is prevented by the one-way clutch 62, the shaft 55 is not rotated. However, since the auxiliary roller 56 is urged against the auxiliary roller 58 with (or without) the interposition of the sheet at a predetermined urging force by the springs 13, 67, the auxiliary roller 56 is driven by the rotation (in the direction shown by the arrow 65) of the auxiliary roller 58 to rotate in the direction shown by the arrow 63. In this way, a normal direction shifting force is applied to the sheet P by the plurality of auxiliary rollers.

When the main roller 5 is rotated in the direction shown by the arrow 31, the gear 60 is rotated in the direction shown by the arrow 63. This rotation is transmitted to the shaft 55 via the one-way clutch 62, thereby rotating the auxiliary roller 56 in the direction shown by the arrow 63. On the other hand, since the rotation of the gear 64 in the same direction as the gear 60 is prevented by the clutch 64, the shaft 57 is not rotated; but, the auxiliary roller 58 is driven by the rotation of the roller 56 to rotate in the direction shown by the arrow 65. In this way, a normal direction shifting force is applied to the sheet P by the plurality of auxiliary rollers.

A plurality of free rollers 69 rotatably mounted on the shaft 55 and a plurality of free rollers 70 rotatably mounted on the shaft 57 and opposed to the free rollers 69 are freely rotated by the shifting movement of the sheet P while preventing the sheet from floating.

When a movable bar 37 is shifted upwardly by a plunger 36 in response to a control signal from the controller 24, a lower end of the movable bar 37 is abutted against a lower surface of a free end of the lever 68, thereby rotating the levers 68, 54 in the clockwise direction. By this rotation, since the auxiliary rollers 56, 58 are separated from each other, the sheet P is shifted only by the conveying force of the main roller 5.

Next, a sheet convey operation of the sheet convey apparatus according to the third embodiment will be explained with reference to FIGS. 5 and 6.

When the sheet P is inserted from a sheet supply opening 2*a* along the sheet supply deck 3 and paper guide 3*a*, a tip end of the sheet is detected by the sensor S1. On the basis of the detection of the sensor, the controller 24 energizes the motor M1 to rotate the main roller 5 in the normal sheet convey direction shown by the arrow 29. The rotation of the main roller 5 is transmitted to the shaft 57 via the gears 23, 59, 61 and the one-way clutch 64 to rotate the auxiliary roller 58 in the direction shown by the arrow 65. By the rotation of the auxiliary roller 58, the tip end of the sheet P is conveyed toward the main roller 5. During this conveyance of the sheet, when the tip end of the sheet is detected by the sensor S1, the controller 24 controls the motor M1 to feed out the sheet by a length L. During rotation of the auxiliary roller 58, the auxiliary roller 56 is driven by the rotation of the auxiliary roller 58 via the sheet P to rotate in the direction shown by the arrow 63.

Then, when the main roller 5 is rotated in the direction by the arrow 31 by a predetermined amount by the controller 24, the rotation (in the direction shown by the arrow 63) of the gear 60 is transmitted to the auxiliary roller 56 via the clutch 62 to rotate the auxiliary roller 56 in the same direction, thereby applying a normal direction conveying force to the sheet P. During this rotation of the auxiliary roller 56, the auxiliary roller 58 is driven by the rotation of the auxiliary roller 56 via the sheet P to rotate in the direction shown by the arrow 65.

During reverse rotation of the main roller 5, when the left and right tip ends of the sheet P are passed by a nip (contact position) between the main roller 5 and the hold-down rollers 11, the left and right tip ends of the sheet P are maintained along the contact position by the shifting force of the auxiliary roller 56. The biasing forces of the springs 13, 67 are selected so that the tip end of the sheet is not flexed by the shifting force of the auxiliary roller.

After a predetermined amount of reverse rotation of the main roller 5, when the main roller 5 is rotated normally by a predetermined amount from the above condition to a position which is referred to as a sheet registration start position, the left and right tip ends of the sheet P pass through the contact position along the contact position by the shifting force of the auxiliary roller 56 and are further conveyed to a record position of the recording head 14 without skew-feed and with high accuracy. Thereafter, since the operation from recording to discharge of the sheet is the same as the first embodiment, the explanation thereof will be omitted.

Next, a fourth embodiment of the present invention will be explained with reference to FIGS. 7 and 8.

Figure 7:
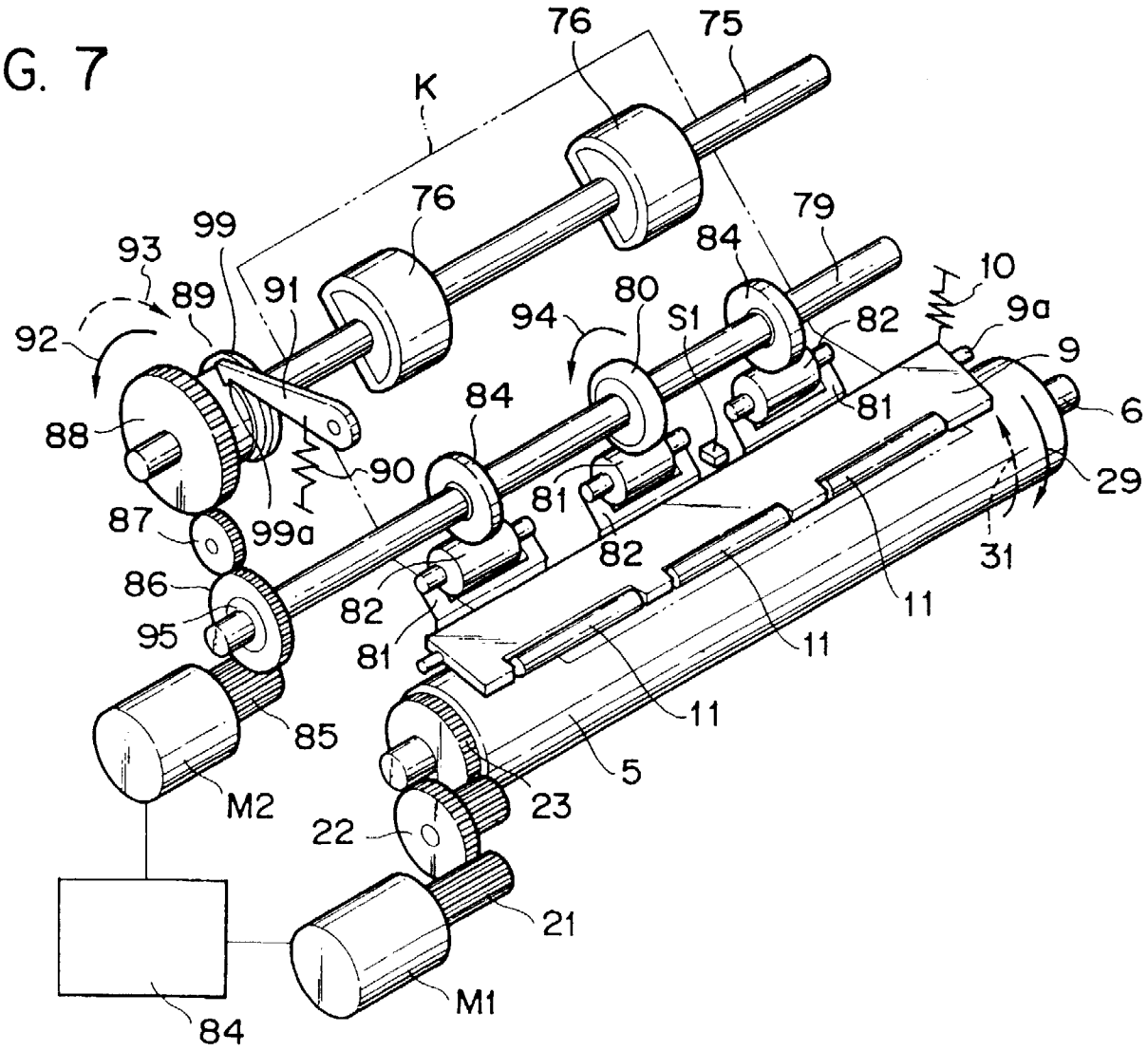
FIG. 7 is a perspective view of a sheet convey apparatus according to a fourth embodiment of the pre sent invention.
Figure 8:
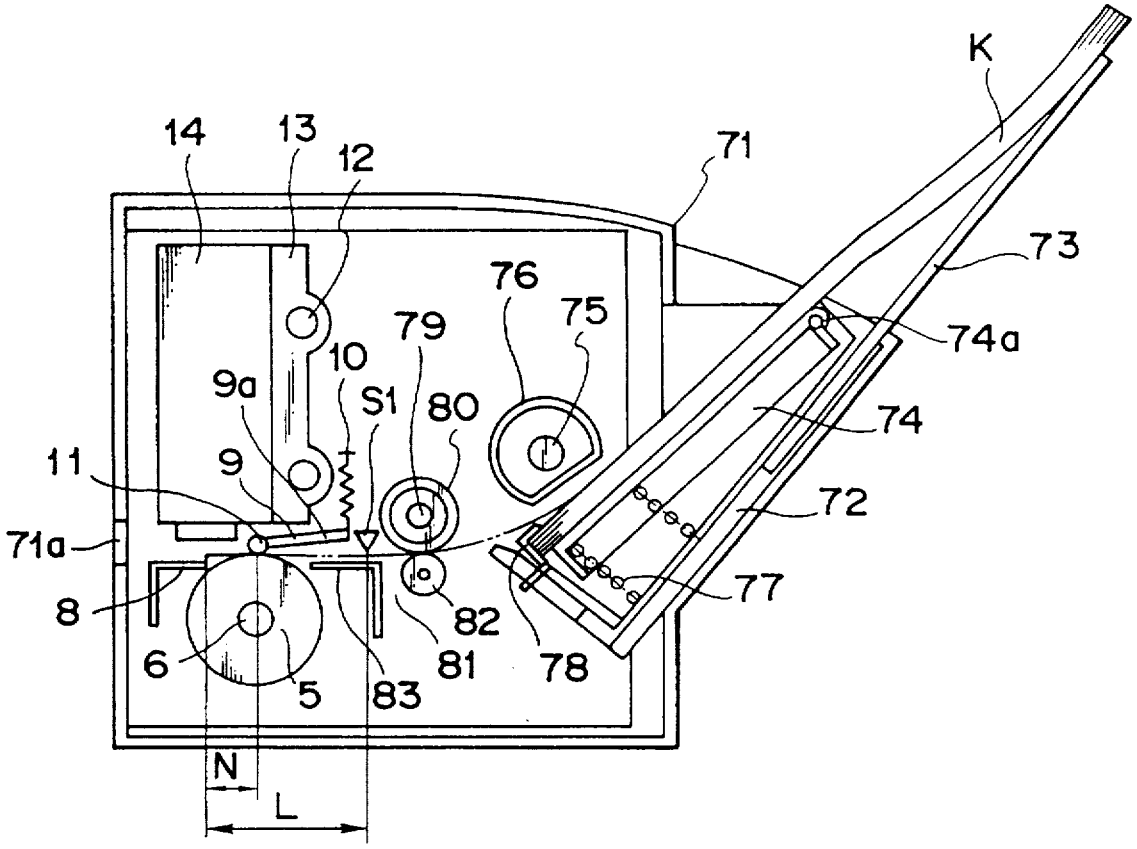
FIG. 8 is a longitudinal side sectional view of a recording apparatus to which the sheet convey apparatus of FIG. 7 is applied.

FIG. 7 iS a schematic perspective view of a sheet convey mechanism of a recording apparatus according to the third embodiment, and FIG. 8 is a sectional view of the recording apparatus. Incidentally, in FIGS. 7 and 8, the same structural and functional elements as those of FIGS. 1 and 2 are designated by the same reference numerals.

In FIG. 8, the recording apparatus comprises a body cover 71 having a discharge opening 71*a*. Inside the body cover 71, there are arranged a hopper 72 for containing a plurality of sheets K, a paper support 73 for holding trailing ends of the sheets, a pressure plate 74 rotatably supported by the hopper 72 via a shaft 74*a*, semi-circular sheet supply rollers 76, a support shaft 75 on which the sheet supply rollers 76 are secured, and a separating pawl 78 provided on the pressure plate 74.

Further, there are arranged an auxiliary roller 80 for conveying a sheet supplied and separated one by one by the sheet supply rollers 76 and the separating pawl 78, a support shaft 79 on which the auxiliary roller 80 is secured, a pinch roller 82 rotatably supported by a spring plate 81 and urged against the auxiliary roller 80, a guide plate 83 for guiding the sheet, a sensor S1 for detecting the movement of the sheet, a platen 8 for establishing a record position for the sheet, a main roller 5 for conveying the sheet, a support shaft 6 on which the main roller 5 is secured, a hold-down plate 9 pivotally mounted around a fulcrum 9*a* and biased by a spring 10 toward the main roller 5, hold-down rollers 11 rotatably mounted on a free end portion of the hold-down plate 9 and adapted to urge the sheet against the main roller 5, a carriage 13 shiftable along a plurality of guide shafts 12 in a widthwise direction of the sheet, and a recording head 14 mounted on the carriage 13 and adapted to perform printing in response to image information. A peripheral surface of the auxiliary roller 80 is constituted by high friction material such as rubber.

In FIG. 7, a motor M1 serves to rotate the main roller 5 via a motor gear 21, a two-stage gear 22 and a main roller gear 23 secured to the shaft 6 in response to a control signal from a controller 84. Further, the controller 84 also controls a motor M2, and a rotational force of the motor M2 is transmitted to a sheet supply roller gear 88 via a motor gear 85, a gear 86 and an intermediate gear 87. The sheet supply roller gear 88 is rotatably mounted on a shaft 75. The rotation of the sheet supply roller gear 88 is transmitted to the sheet supply rollers 76 via a one revolution spring clutch 89 and the shaft 75.

Figure 10:
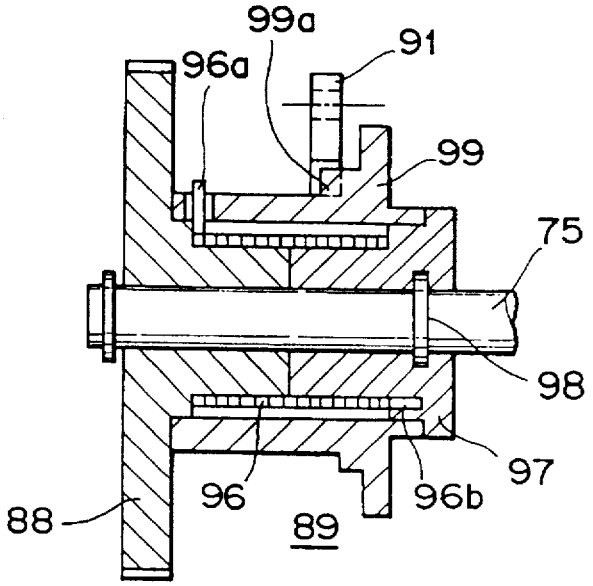
FIG. 10 is a longitudinal side sectional view of a spring clutch portion.

In FIG. 10, which is a sectional view of the one revolution spring clutch 89, a cylinder 97 secured to the shaft 75 by a spring 96 and a pin 98 is arranged within a cam ring 99. The spring 96 is wound around a boss portion of the sheet supply roller gear 88 and the cylinder 97, and one end of the spring 96 is connected to the cam ring 99 and the other end of the spring is connected to the cylinder 97.

With this arrangement, during rotation of the shaft 75 due to the rotation of the sheet supply roller 88 in a direction shown by the arrow 92, when a free end of a lever 91 is caught by a projection 99*a* of the cam ring 99, the rotation of the cam ring 99 is stopped. Further, the support shaft 75 connected to the cam ring 99 via the spring 96 and the cylinder 97 is also stopped. In this condition, since the end 96*a* of the spring 96 is also stopped, the winding force of the spring 96 with respect to the boss portion of the sheet supply roller gear 88 is loosened, with the result that only the sheet supply roller gear 88 continues to rotate.

On the other hand, when the sheet supply roller gear 88 is rotated in the direction shown by the arrow 83 by a predetermined amount by the motor M2, the free end of the lever 91 is disengaged from the projection 99*a*, thereby tightening the spring 96, with the result that the sheet supply roller gear 88 is connected to the support shaft 75 to rotate in a direction shown by the arrow 92, thereby rotating the sheet supply rollers. Rollers 84 rotatably mounted on the shaft 79 are contacted with other pinch rollers 82 and are driven by the movement of the sheet K to direct the sheet K to the main roller 5.

Next, a sheet convey operation of the sheet convey apparatus according to the fourth embodiment will be explained with reference to FIGS. 7 and 8.

In response to a sheet supply command from a computer, the controller 84 energizes the motor M1 to rotate the main roller 5 in the normal sheet convey direction shown by the arrow 29. At the same time, the controller 84 also energizes the motor M2 to rotate the sheet supply roller gear 88 in the direction shown by the arrow 93 by a predetermined amount. As a result, since the free end of the lever 91 is disengaged from the projection 99*a*, the spring 96 is tightened, with the result that the rotation of the sheet supply roller gear 88 is transmitted to the sheet supply rollers 76, thereby rotating the roller 76 in the direction shown by the arrow 92. When a largest diameter portion of each sheet supply roller 76 is contacted with the upper surface of the sheet stack K, the uppermost several sheets K are shifted toward the separating pawl, where only the one uppermost sheet is separated. The separated sheet is conveyed toward the main roller 5 by the sheet supply rollers 76 and the auxiliary roller 80.

When the tip end of the sheet K is detected by the sensor S1, the controller 84 controls the rotational amount of the motor M1 to convey the tip end of the sheet by a length L shown in FIG. 8. Since the protruded amount N of the tip end of the sheet was previously explained in connection with the first embodiment, the explanation will be omitted here.

Then, the controller 84 rotates the motor M1 reversely to rotate the main roller 5 in the direction shown by the arrow 31 by a predetermined amount, thereby shifting the sheet K in the reverse direction. At the same time, the controller 84 also rotates the motor M2 to rotate the auxiliary roller 80 in the direction shown by the arrow 94, thereby applying a normal direction shifting force to the sheet K.

The following is a description of two methods for applying a shifting force to the sheet K using the auxiliary roller 80.

In a first method, the peripheral speed of the auxiliary roller 80 is set to a normal or usual peripheral speed. On the other hand, when the spring force of the spring plate 81 for urging the sheet K against the pinch roller 82 abutted against the auxiliary roller 80 is made as small as possible within a range satisfying the normal direction conveying force, the auxiliary roller 80 slips on the surface of the sheet K, thereby applying a normal direction shifting force to the sheet K. In this method, if a sheet having a hard surface is used, it is feared that the surface of the sheet will be rubbed by the above-mentioned slip, thereby damaging the sheet. In order to prevent damage to the sheet, the controller 84 controls the motor M2 to decrease the peripheral speed of the auxiliary roller 80. As a result, since a distance that the auxiliary roller 80 slips on the surface of the sheet is decreased, the rubbing force of the auxiliary roller is weakened, thereby preventing damage to the sheet.

In a second method for applying a shifting force to the sheet K using the auxiliary roller 80, the motor M2 is controlled so that, during the rotation of the main roller in the direction shown by the arrow 31, while the sheet K is being shifted in the reverse direction, the auxiliary roller 80 is driven while applying a normal direction shifting force to the sheet to rotate in a direction opposite to the direction shown by the arrow 94. This method is effected by the controller 84 in such a manner that a current and/or a voltage supplied to the motor M2 is controlled to make the normal direction shifting force applied to the sheet K by the motor M2 via the auxiliary roller 80 smaller than the rotational force applied to the auxiliary roller 80 by the reversed sheet K.

When the tip end of the sheet is passed through the contact position between the main roller 5 and the hold-down rollers 11 by rotation of the main roller 5 in the direction shown by the arrow 31, even if a time difference occurs between the left tip end and the right tip end of the sheet, since the auxiliary roller 80 applies the shifting force to the sheet K substantially at a central portion of the sheet, when the whole tip end of the sheet has passed through the contact position, the sheet K is rotated around a contact point between the sheet and the auxiliary roller 80. Further, since the tip end of the sheet is urged against the contact position between the main roller 5 and the hold-down rollers 11 by the shifting force, the sheet is maintained along the contact position. From the above condition, when the main roller 5 is rotated in the direction shown by the arrow 29 by a predetermined amount by the controller 84, the left and right tip ends of the sheet K are again passed through the contact position along the contact position by the normal direction shifting force of the auxiliary roller 80, and then the sheet is conveyed to the record position of the recording head 14 without skew-feed and with high accuracy.

Then, in response to a record signal, the sheet K is fed in the normal direction by a predetermined amount by the main roller 5, and the carriage 13 is reciprocally shifted in the widthwise direction of the sheet, thereby effecting one line recording by the recording head 14. By repeating these operations, one page recording is effected on the sheet.

During the conveyance of the sheet K by the main roller 5, although the motor M2 is stopped, the auxiliary roller 80 can freely be rotated in the direction shown by the arrow 94 by the action of the one-way clutch 95, with the result that since the auxiliary roller 80 follows the normal direction movement of the sheet K due to the main roller 5, the auxiliary roller 80 does not affect the load applied to the main roller 5, thereby permitting the conveyance of the sheet with high accuracy by the main roller 5.

Incidentally, in the above-mentioned embodiment, while the apparatus in which the shifting force is applied to the sheet by the auxiliary roller, the auxiliary roller 80 and its pinch roller 82 may be omitted and the sheet supply rollers 76 may have above-mentioned function same as that of the auxiliary roller 80. Also in this case, the same technical effect as the aforementioned embodiment can be achieved.

As fully mentioned above, in the sheet convey apparatus according to the present invention, the auxiliary roller is arranged at an upstream side of the main roller, and, during the reverse movement of the sheet by a reverse rotation of the main roller, the auxiliary roller applies the normal direction shifting force to the tip end of the sheet, thereby aligning the tip end of the sheet with the generatrix of the main roller with high accuracy, and further, the sheet is conveyed to the predetermined record position with high accuracy by the normal rotation of the main roller while maintaining the above condition. When the functions and operations of the main roller and the auxiliary roller are applied to register rollers used in a printing apparatus such as a copying machine, the same technical effect can be achieved.

Figure 11:
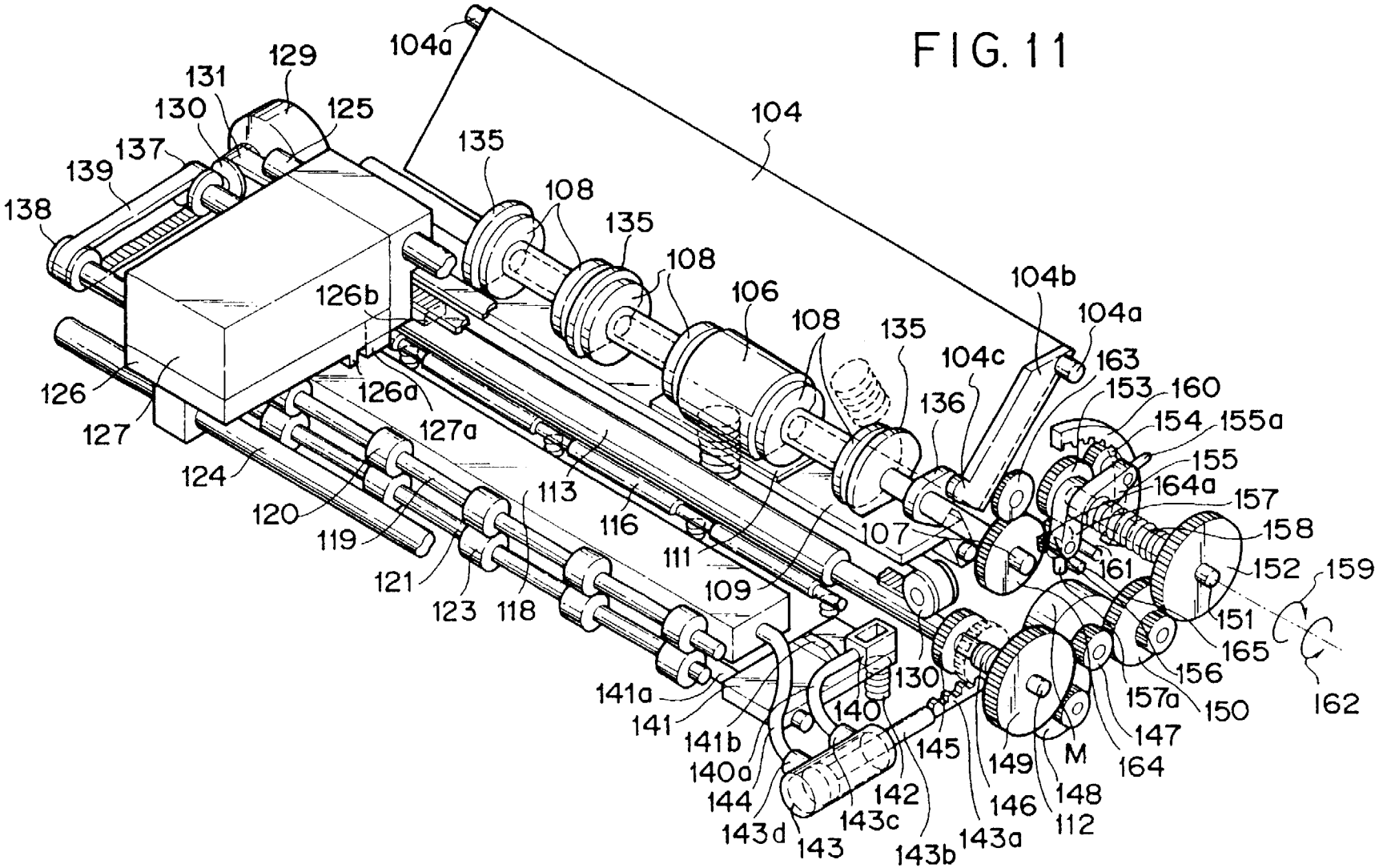
FIG. 11 is a perspective view of a sheet supply apparatus to which the present invention is applied.
Figure 12:
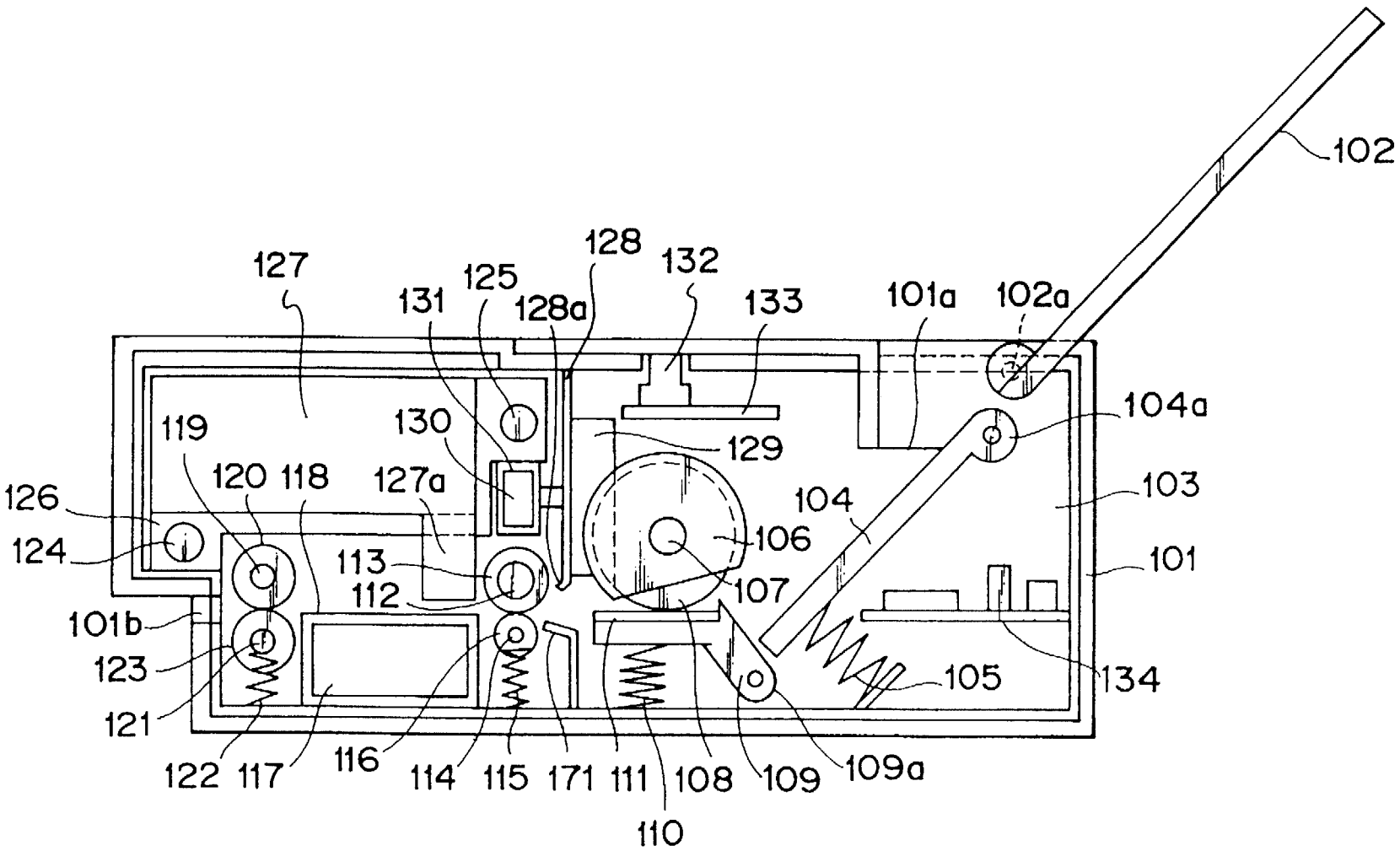
FIG. 12 is a sectional view of the sheet supply apparatus to which the present invention is applied.

FIGS. 11 and 12 show a fifth embodiment of the present invention applied to an ink jet printer, where FIG. 11 is a schematic perspective view showing certain mechanisms of the printer, and FIG. 12 is a sectional view of the printer.

In FIG. 12, the printer comprises an outer cover 101 and a lid 102 pivotally mounted around a shaft 102*a*, which lid 102 also serves as a sheet tray. A sheet is inserted from an insertion opening 101*a* formed in the cover 101 and is discharged from a discharge opening 101*b*.

Within a plurality of side plates 103 in the cover 101, there are arranged a sheet stacking plate 104 pivotally mounted on a shaft 104*a* and biased upwardly by a spring 105 toward a sheet supply roller 106, the sheet supply roller 106 being secured to a shaft 107 and having a large diameter portion (which can be contacted with a sheet) and a small diameter portion (which does not contact the sheet), sheet hold-down rollers 108 rotatably mounted on the shaft 107 and each having a radius shorter than the larger diameter portion of the sheet supply roller 106 and longer than the small diameter portion, a separation plate 109 rotatably mounted on a shaft 109*a* and biased by a spring 110 to be urged against the large diameter portion of the sheet supply roller 106 and the hold-down rollers 108 via a separation pad 111 having a high friction surface, a main roller 113 secured to a shaft 112 and adapted to convey a sheet (supplied by the sheet supply roller 106 and guided by an upper sheet guide 128*a* and a lower sheet guide 171) at a constant speed, first pinch rollers 116 rotatably mounted on a shaft 114 and adapted to urge the sheet against the main roller by force of springs 115 via the shaft 114, a platen 118 including an ink absorb material 117 therein, sheet discharge rollers 120 secured to a shaft 119 and adapted to discharge a sheet, second pinch rollers 123 rotatably mounted on a shaft 121 and adapted to urge a sheet against the discharge rollers by force of springs 122 via the shaft 121, a carriage 126 shiftable along guide shafts 124, 125 in a widthwise direction of the sheet, and a recording head 127 mounted on the carriage and adapted to effect printing by discharging ink from discharge opening portion 127*a* in response to image information.

The carriage 126 is driven by a motor 129 provided on a central side plate 128 having the sheet guide 128*a*, a pulley 130 secured to an output shaft of the motor, and a belt 131 wound around the pulley 130 and having one end attached to the carriage 126.

Further, within the cover 101, there are arranged an electric operation substrate 133 having a plurality of switch buttons 132 protruding from holes of the cover 101, and an electric control substrate 134 on which a computer and memories are provided and adapted to control the operation of the printer.

In FIG. 11, a plurality of auxiliary sheet supply rollers 135 are secured to the shaft 107, each having a large diameter portion and a small diameter portion that cooperate with the sheet supply roller 106 along the whole width of the sheet, thereby supplying the sheet. A cam plate 136 secured to the shaft 107 is always abutted against a protruded portion 104*c* of a guide portion 104*b* provided on the sheet stacking plate 104 by the action of the spring 105, so that, when the cam plate 136 is rotated together with the sheet supply roller 106, the sheet stacking plate 104 is lifted and lowered. Since a pulley 137 provided at one end of the main roller shaft 112 and a pulley 138 provided at one end of the discharge roller shaft 119 are interconnected via belt 139, the rotation of a motor M is transmitted to the discharge rollers 120 via the shaft 112.

A cap support 141 on which a cap 140 for covering the discharge opening portion 127*a* of the recording head 127 is arranged has a rotary shaft 141*a*, and a push-down cam portion 141*b*. Since the cap support 141 is biased around the shaft 141*a* toward an anti-clockwise direction by a spring 142, during the shifting movement of the carriage 126, when a projection 126*a* of the carriage 126 abuts against the push-down cam 141*b*, the cap support 141 is lowered in opposition to the force of the spring 142, thereby lowering the cap 140. When the projection 126*a* passed by the push-down cam 141*b*, the cap 140 is lifted to closely contact the discharge opening portion 127*a*, thereby covering the portion 127*a*.

A pump 143 has a piston shaft 143*b* on which a rack 143*a* is formed, a suction port 143*c*, and a discharge port 143*d*, and the suction port 143*c* is connected to the cap 140 via a tube 140*a* and the discharge port 143*d* is connected to the platen 118 via a tube 144, so that ink sucked from the cap 140 can be discharged to the ink absorbing material 117 in the platen 118.

A pump drive gear 145 is provided on the shaft 112 so that it can be moved along the shaft 112 and it can be rotated together with the shaft 112. Normally, the pump drive gear 145 is biased by a spring 146 so as not to engage the rack 143*a*. Solid matters are apt to be adhered to the discharge opening portion of the recording head 127 and therearound, thereby causing poor ink discharge. In such a case, in order to effect a poor discharge recovery operation, under the command from a controller 134, the carriage 126 is shifted to contact the discharge opening portion 127*a* with the cap 140.

In response to the shifting movement of the carriage 126, since the projection 126*a* of the carriage 126 shifts the pump drive gear 145 to a position shown by the two-dot and chain line, the gear 145 is engaged by the rack 143*a*. In this condition, when the gear 145 is rotated alternatively in the normal and reverse directions repeatedly within a predetermined angle range by the motor M, the rack 143*a* repeats the reciprocal movements in a straight direction. Since a piston is moved together with the piston shaft 143b, the pump 143 sucks the ink and the solidified ink from the discharge opening portion 127a, and the sucked ink is discharged to the ink absorbing material 117 in the platen 118.

In response to a signal from the controller 134, the motor M rotates the main roller 113 via an output gear 147, a two-stage gear 148 and a main roller gear 149 secured to the shaft 112, thereby conveying the sheet. On the other hand, the motor M rotates a shaft 151 via the output shaft 147, a two-stage gear 150 and a gear 152 secured to the shaft 151. A first carrier 155 rotatably supporting a first planetary gear 154 meshed with a sun gear 153 secured to the shaft 151 and a second carrier 157 rotatably supporting a second planetary gear 156 are rotatably supported on the shaft 151, and the carrier is urged against the side surface of the sun gear 153 by a spring 158 so that the carrier is driven by the rotation of the sun gear 153. When the shaft 151 is rotated in a direction shown by the arrow 159 by the rotation of the motor M for rotating the main roller 113 to convey the sheet to the normal direction, the first planetary gear 154 is driven by the sun gear 153, with the result that the first planetary gear 154 is rotated and revolved while meshing with an inner gear 160. When the first planetary gear is disengaged from the inner gear 160, a pin 155a is abutted against a pin 161, thereby stopping the revolution of the planetary gear.

When the shaft 151 is rotated in a direction shown by the arrow 162 by the rotation of the motor M for rotating the main roller 113 to convey the sheet in the reverse direction, the first planetary gear 154 is rotated and revolved in the direction shown by the arrow 162. When the first planetary gear is disengaged from the inner gear 160, the planetary gear is engaged by a gear 163. In this condition, when the motor M continues to rotate in the direction shown by the arrow 162, the sun gear 153 rotates a notched gear 164 secured to the shaft 107 and having a notched portion 164a via the first planetary gear 154 and the gear 163, and the notched gear 164 transmits the rotation in the sheet supply direction to the sheet supply roller 106 via the shaft 107. When the notched gear 164 continues to rotate and the notched portion 164a reaches the gear 163, the gear 163 is rotated idly not to transmit the rotation to the notched gear 164, thereby stopping the notched gear 164 and the sheet supply roller 106.

By the rotation of the shaft 151 in the direction shown by the arrow 162, the second planetary gear 156 is revolved in the same direction until a pin 157a of the carrier 157 is abutted against a pin 165. After this condition, when the shaft 151 is rotated in the direction shown by the arrow 159, the second planetary gear 156 is revolved in the same direction to continue to be engaged by the notched gear 164, so that the sun gear 153 transmits the rotation in the sheet supply direction to the sheet supply roller 106 via the second planetary gear 156 and the notched gear 164. When the notched gear 164 continues to rotate and the notched portion 164a reaches the second planetary gear 156, the second planetary gear 156 is rotated idly not to transmit the rotation to the notched gear 164, thereby stopping the notched gear 164 and the sheet supply roller 106.

Figure 13:
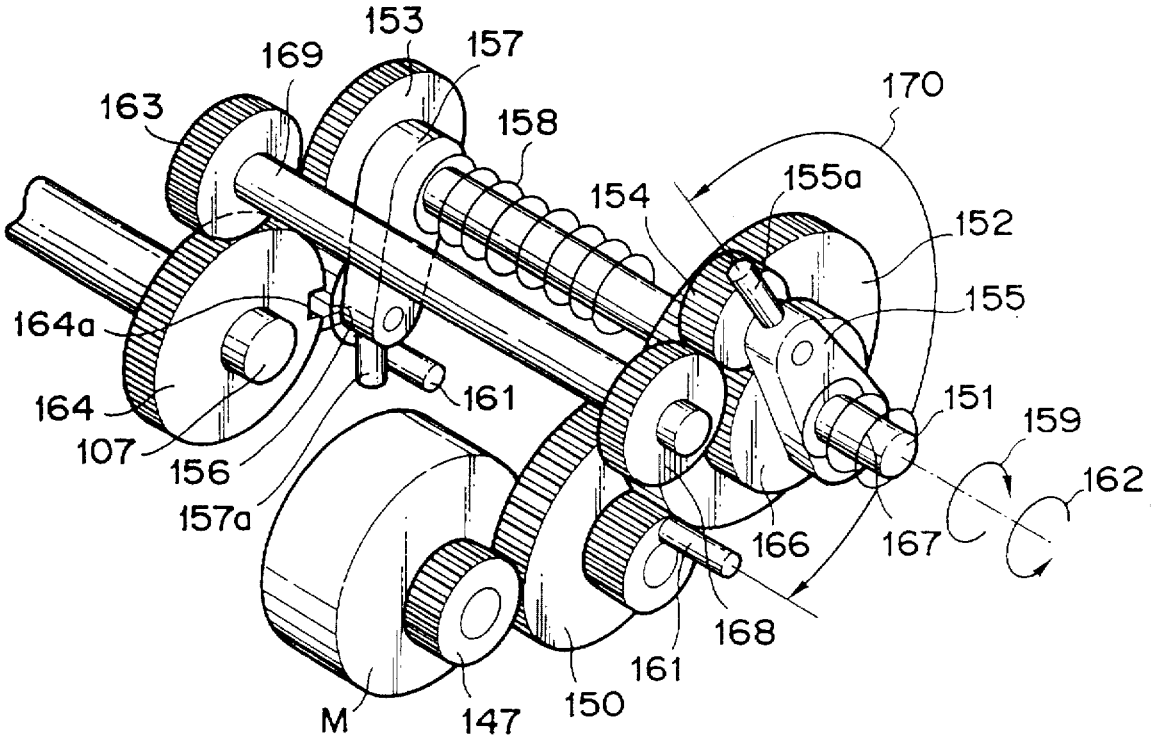
FIG. 13 is a perspective view showing an embodiment of the present invention.

Next, a modification of the transmission portion will be explained with reference to FIGS. 11 and 13. In FIG. 13, the same elements as those in FIG. 11 are designated by the same reference numerals.

In FIG. 13, a gear 166 having the same configuration as the sun gear 153 of FIG. 11 is secured to the shaft 151 in an opposed relation to the sun gear 153. The first planetary gear 154, revolved while engaging the gear 166 is rotatably supported by the carrier 155. Since the carrier 155 is urged against a side surface of the gear 166 by a spring 167, the carrier 155 is driven by the rotation of the gear 166 to rotate in the same direction as the gear 166. Further, a gear 168 having the same configuration as the gear 163 of FIG. 11 is secured to a shaft 169 in an opposed relation to the gear 163, so that, when the gear 168 is driven by the first planetary gear 154, the gear 163 is also rotated. Now, when the arrangement of FIG. 11 is so designed that the speed reduction ratio from the motor M to the main roller shaft 112 is the same as the speed reduction ratio from the motor M to the shaft 151 and the pump drive gear 145 drives the pump 143 by its normal and reverse rotations of 125°, in FIG. 13, in order not to rotate the sheet supply roller 106 by the rotation of the shaft 151 in the direction shown by the arrow 162, a non-synchronous movement zone 170 from a position where the pin 155a is contacted with the pin 161 to a position where the first planetary gear 154 is engaged by the gear 168 must have an angle greater than 250°. For example, the angle of the non-synchronous movement zone 170 is set to 280° in consideration of the margin. Accordingly, in order to increase the revolution angle of the first planetary gear 154, in FIG. 13, two sun gears are provided to reverse the non-synchronous movement zone. On the other hand, regarding the rotation of the shaft 151 in the direction shown by the arrow 159, when the pump 143 is operated, since the second planetary gear 156 is always rotated idly by the presence of the notched portion 164a not to transmit the rotation to the notched gear 164, the sheet supply roller 106 is not driven.

In the arrangement of the transmission portion in FIG. 13, since the revolution angle of the first planetary gear 154 is increased, and requires a large space and an increase in the number of gears and shafts, it is difficult to make the apparatus small-sized. The arrangement of the transmission portion of FIG. 11 solves the above problem by using the inner gear.

Now, the inner gear will be explained with reference to an example of the design of the inner gear 160. When the number of teeth of the sun gear 153 is $Z_1$ (=18), the module thereof is $M_1$ (=0.6), the number of teeth of the first planetary gear 154 is $Z_2$ (=10) and the module thereof is $M_2$ (=0.6), in the specification of the inner gear 160, the number of teeth of the inner gear becomes $Z_3$ (=38) and the module thereof becomes $M_3$ (=0.6). On the other hand, when the first planetary gear 154 is rotated by 280°, the sun gear 143 advances by 14 teeth. When the sun gear 153 advances by 14 teeth, the first planetary gear 154 is rotated, while engaging the inner gear 160 and is revolved by 14 teeth of the inner gear 160.

The 14 teeth of the inner gear 160 correspond to an angle of about 133°. Accordingly, in comparison with the example of FIG. 13, it is possible to reduce the revolution angle, with the result that it is possible to arrange a plurality of planetary gears around a single sun gear, thereby permitting the size reduction of the transmission portion. Further, since the revolution of the first planetary gear 154 is effected while engaging the planetary gear by the fixed inner gear 160, there is no slip and the like, thus achieving the positive operation.

Other than the above-mentioned design, depending upon the combination of the number of teeth of the sun gear and the number of teeth of the planetary gear, it is possible to further reduce the revolution angle.

Next, a sheet supply operation according to a fifth embodiment will be explained with reference to FIGS. 11, 12 and 14 to 18. FIGS. 14 to 18 are sectional views showing the main sheet supply members of FIG. 11. Incidentally, in FIGS. 14 to 18, the same elements as those of FIG. 11 are designated by the same reference numerals.

Figure 14:
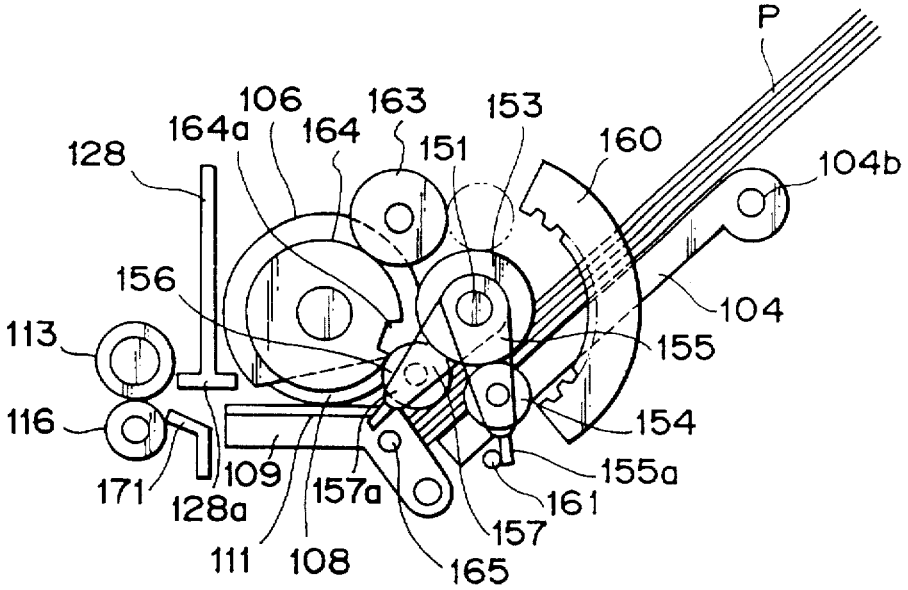
FIGS. 14 to 18 are views for explaining an operation of a sheet supply apparatus to which the present invention is applied.

In FIG. 14, the upper sheet guide 128*a* provided on the end of the intermediate side plate 128 along the whole width of the sheet and the lower sheet guide 171 arranged along the whole width of the sheet serve to guide the sheet P supplied by the sheet supply roller 106 to the nip between the main roller 113 and the main pinch rollers 116 without bending the sheet, and a distance between the upper guide 128*a* and the lower guide 171 is gradually decreased as the guides approach the nip between the main roller 113 and the main pinch rollers 116. FIG. 14 shows a condition before the sheet supply operation is started. In this condition, the sheet stacking plate 104 is in a lowered position, the pin 155*a* is abutted against the pin 161, the second planetary gear 156 faces the notched portion 164*a* of the notched gear 164, the separation pad 111 is contacted with the hold-down rollers 108, and a plurality of sheets P are stacked on the sheet stacking plate 104.

Figure 15:
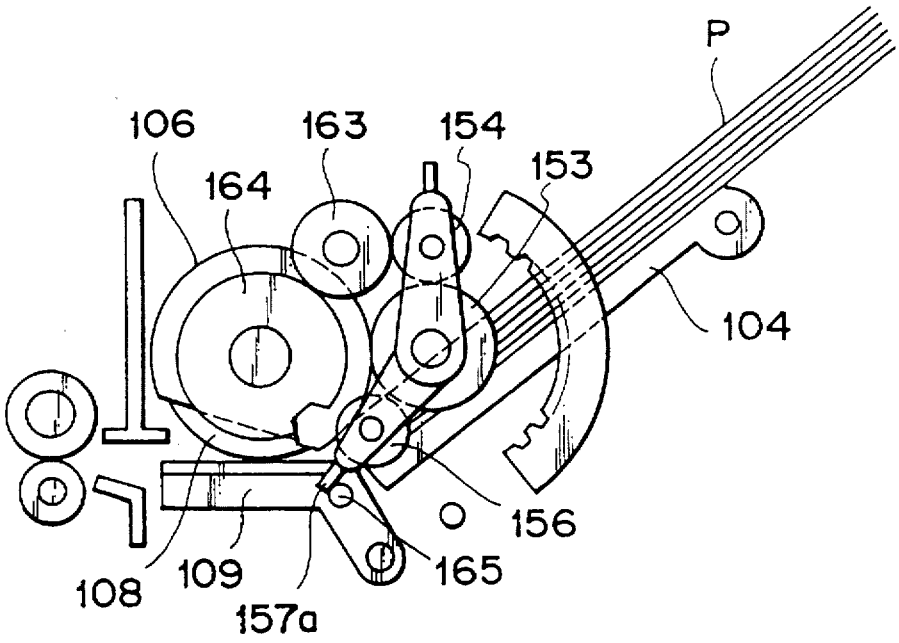

Then, in response to a command from the controller 134 shown in FIG. 12, when the shaft 151 is rotated in the direction shown by the arrow 162 by the motor M shown in FIG. 11, the first planetary gear 154 is rotated while engaging the inner gear 160, and is further revolved around the sun gear 153 to engage the gear 163, thereby establishing a condition shown in FIG. 15. In FIG. 15, the sheet supply roller 106 rotated in the sheet supply direction by the sun gear 153, first planetary gear 154, gear 163 and notched gear 164 shifts several sheets on the sheet stack P on the elevated sheet stacking plate 104 into the gap between the hold-down rollers 108 and the separation plate 109. On the other hand, the second planetary gear 156 is also revolved in the direction shown by the arrow 162 until the pin 157*a* abuts against the pin 165. By such revolution, the second planetary gear 156 is disengaged from the notched gear 164.

Figure 16:
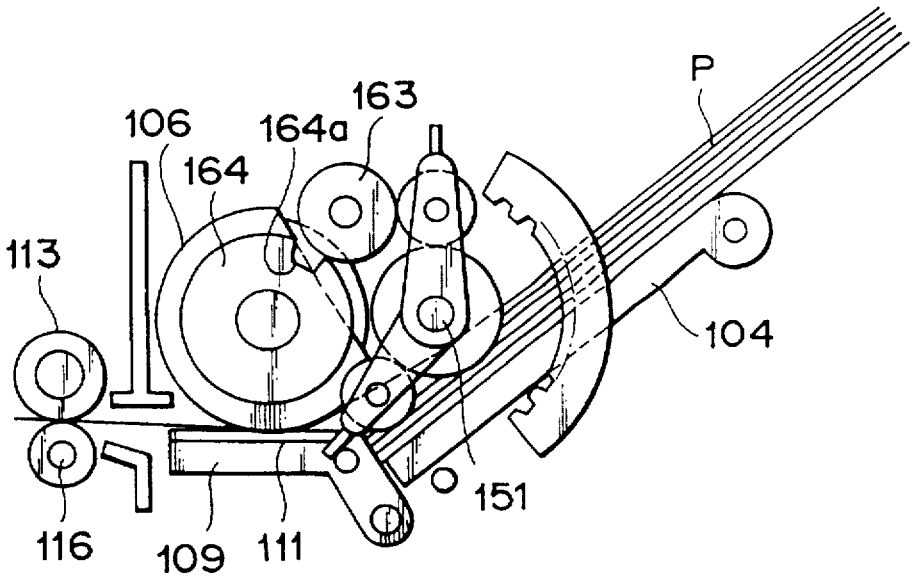

FIG. 16 shows a condition in which the sheet supply roller 106 was further rotated in the sheet supply direction by the further rotation of the shaft 151 in the direction shown by the arrow 162. In this condition, the sheets are separated one by one by the cooperation of sheet supply roller 106 and the separation pad 111, and the tip end of a separated sheet P is conveyed to the contact position (nip) between the main roller 113 and the main pinch rollers 116 which are rotated in a direction opposite to the sheet supply direction. Since the sheet conveyed up to the contact position cannot be further advanced, the sheet supply roller 106 is rotated while slipping on the sheet P without flexing the sheet. Such slip can be obtained by the proper pressure from the springs 105, 110.

Then, when the notched portion 164*a* reaches the gear 163, the gear is rotated idly to disconnect the driving force of the motor M from the sheet supply roller 106, thereby stopping the sheet supply roller 106. In condition in which the sheet supply roller 106 is stopped, since if the sheet is flexed the sheet supply roller is rotated reversely by the flexed sheet not to stop the sheet supply roller completely, it is necessary to supply the sheet without being flexed. During the rotation of the notched gear 164, since the sheet stacking plate 104 is lowered, the sheet is not urged against the sheet supply roller due to the lifting movement of the sheet stacking plate 104, so that the next sheet is not drawn by the sheet supply roller 106.

Figure 17:
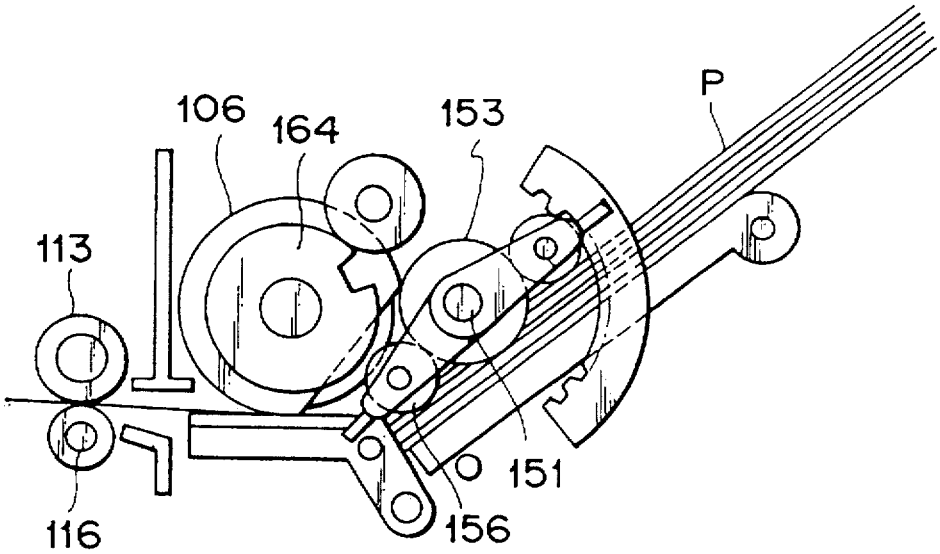

FIG. 17 shows a condition in which the shaft 151 was rotated in the direction shown by the arrow 159 in FIG. 12 by the rotation of the motor for rotating the main roller 113 in the normal sheet convey direction. In this condition, the second planetary gear 156 is revolved in the direction shown by the arrow 159 to engage the notched gear 164. By this engagement, the sheet supply roller 106 is rotated in the sheet supply direction by the sun gear 153, second planetary gear 156 and notched gear 164. The rotation of the sheet supply roller 106 causes the sheet P to pass through the contact position between the main roller 113 and the main pinch rollers 116. In this case, the main roller 113 is being rotated in the normal sheet convey direction.

Figure 18:
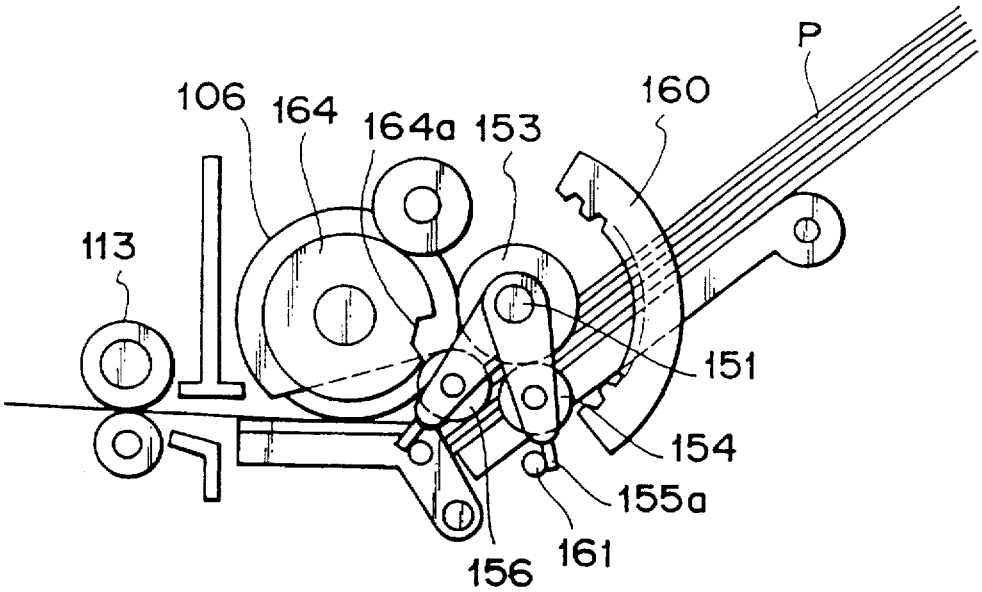

FIG. 18 shows a condition in which the sheet supply roller 106 was finally rotated by further rotation of the shaft 151 in the direction shown by the arrow 159. In this condition, when the notched portion 164*a* reaches the second planetary gear 156 by rotation of the notched gear 164, the second planetary gear 156 is disengaged from the notched gear 164 to idly rotate, thereby disconnecting the driving force of the motor M from the sheet supply roller 106. As a result, although the sheet supply roller 106 is stopped while separating from the surface of the sheet P, the main roller 113 conveys the sheet P to the predetermined position. During the conveyance of the sheet, hold-down rollers 108 are rotated by the movement of the sheet. As the sun gear 153 continues to rotate in the direction shown by the arrow 159, the second planetary gear 156 is revolved while engaging the inner gear 160 until the pin 155*a* abuts against the pin 161.

As a further movement, in FIG. 12, the sheet P is fed in the normal direction by the predetermined amount by the motor M in response to the print signal from the controller 134, and the carriage 126 is reciprocally shifted in the widthwise direction of the sheet, during which one line printing is effected by discharging ink from the discharge opening portion 127*a* of the recording head 127. By repeating such operations, one page printing is completed. After the printing, the sheet P is discharged from the discharge opening 101*b* by the discharge rollers 120.

As fully mentioned above, in the transmission portion according to this embodiment, the rotational amount in the direction shown by the arrow 162 required by the motor M is the sum of the revolution amount of the first planetary gear 154 and the rotational amount of the notched portion 164*a* of the notched gear 164 up to the gear 163; whereas, the rotational amount in the direction shown by the arrow 159 required by the motor M is the sum of the revolution amount of the second planetary gear 156 and the rotational amount of the notched portion 164*a* of the notched gear 164 up to the second planetary gear 156 and the idle rotation amount of the second planetary gear 156. Thus, in both cases, by appropriately setting the idle rotation amount, the rotation position of the sheet supply roller 106 is accurately controlled by the notched portion 164*a* without the accurate control of the motor M.

Figure 19:
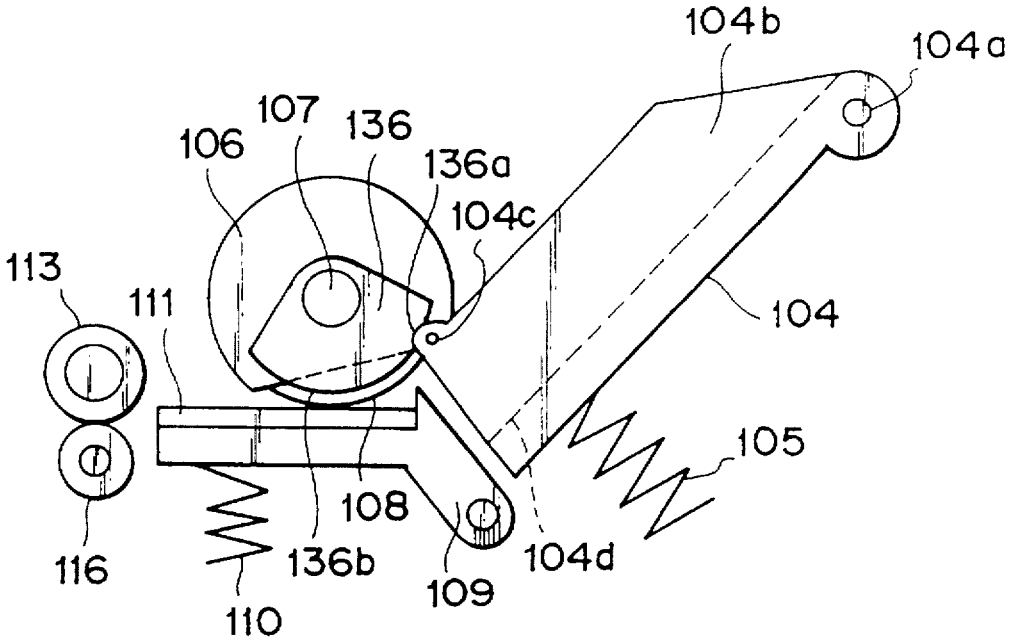
FIGS. 19 to 21 are views for explaining an operation of a sheet stacking plate of a sheet supply apparatus to which the present invention is applied.
Figure 20:
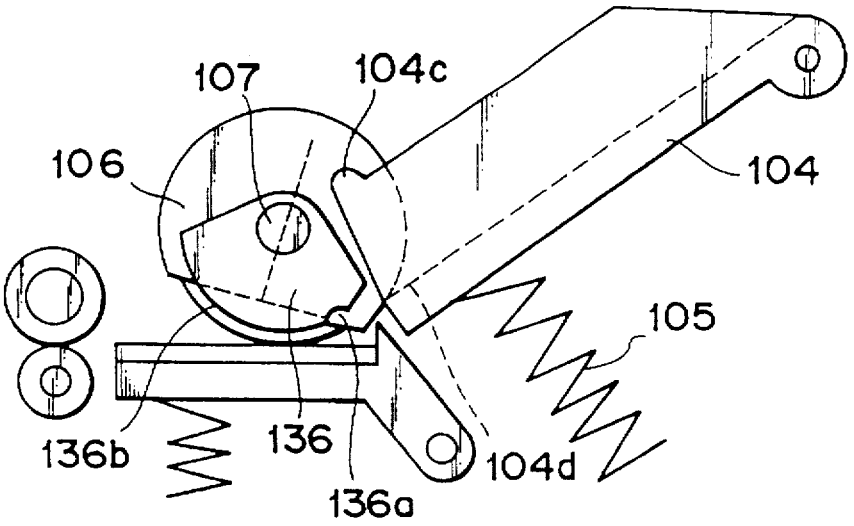
Figure 21:
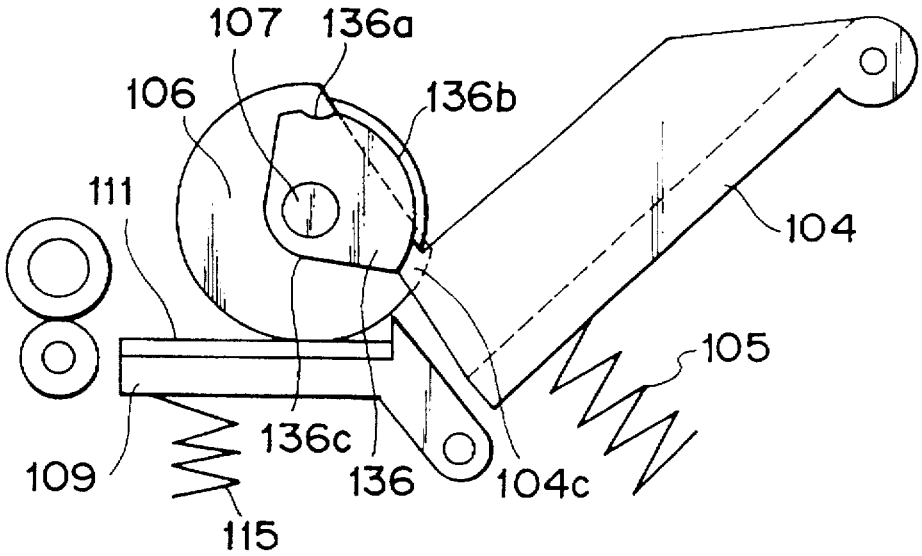

Next, the operation of the sheet stacking plate 104 in the fifth embodiment will be explained with reference to FIGS. 11, 12 and 19 to 21. FIGS. 19 to 21 are sectional views showing main members associated with the operation of the sheet stacking plate 104 in FIG. 11.

In FIG. 19, a free end 104*d* of the sheet stacking plate 104 pivotally mounted on the shaft 104*a* is always biased upwardly by the spring 105. By this upward biasing force, rotation of the cam plate 136 is prevented in a condition in which the projection 104*c* of the guide portion 104*b* is received in a recess 136*a* of the cam plate 136 secured to the shaft 107. In the position where the projection 104*c* is received in the recess 136*a*, the cam plate 136 maintains the sheet stacking plate 104 in the lowered position.

In FIG. 20, when the sheet supply roller 106 is rotated in the sheet supply direction, since the cam plate 136 is also rotated in synchronism with the sheet supply roller 106 via the shaft 107, the projection 104*c* moves out of the maximum lift profile 136*b* of the cam plate 136, with the result that the free end 104*d* of the sheet stacking plate 104 is lifted by the force of the spring 105 until it contacts the large diameter portion of the sheet supply roller 106. In this condition, the sheet stack resting on the sheet stacking plate 104 is urged against the large diameter portion of the sheet supply roller 106 so that a sheet can be fed out by the rotation of the sheet supply roller 106.

In FIG. 21, when the cam plate 136 is further rotated in synchronism with the further rotation of the sheet supply roller 106 in the sheet supply direction, the projection 104*c* is pushed by the cam surface 136*c* of the cam plate 136 and then the projection continues to be pushed by the maximum lift profile 136*b*, and, at last, the condition shown in FIG. 19 is restored. In this condition, since the free end 104*d* is separated from the large diameter portion of the sheet supply roller 106, the sheet supply roller 106 does not shift the sheet in this position; on the other hand, the sheet urged against the sheet supply roller 106 by the spring 105 via the separation pad 111 is shifted by the rotation of the sheet supply roller 106.

Figure 22:
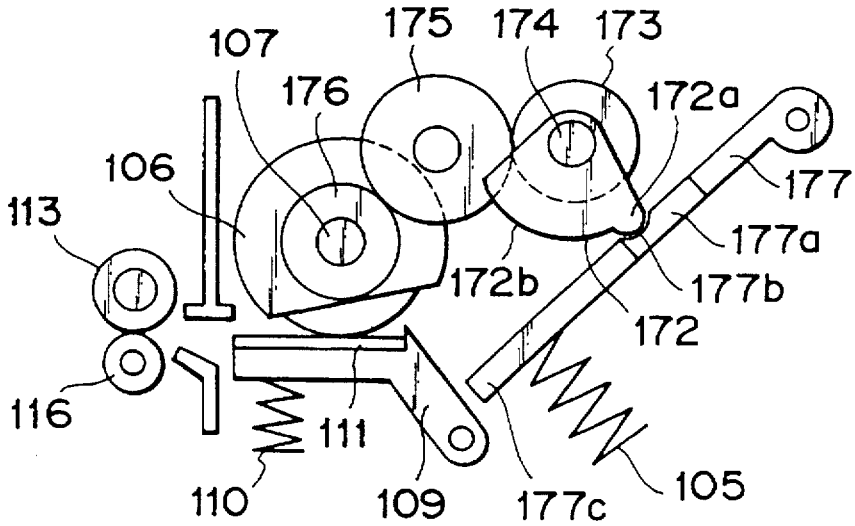
FIGS. 22 to 24 are views for explaining an operation of a sheet stacking plate of a sheet supply apparatus according to a further embodiment of the present invention.
Figure 23:
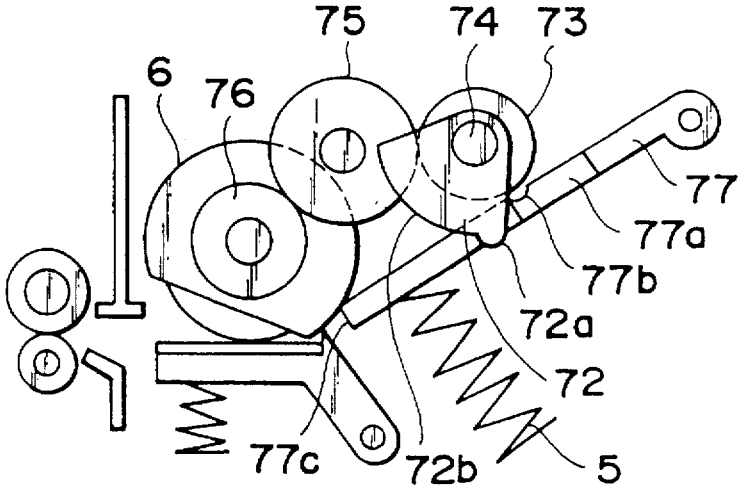
Figure 24:
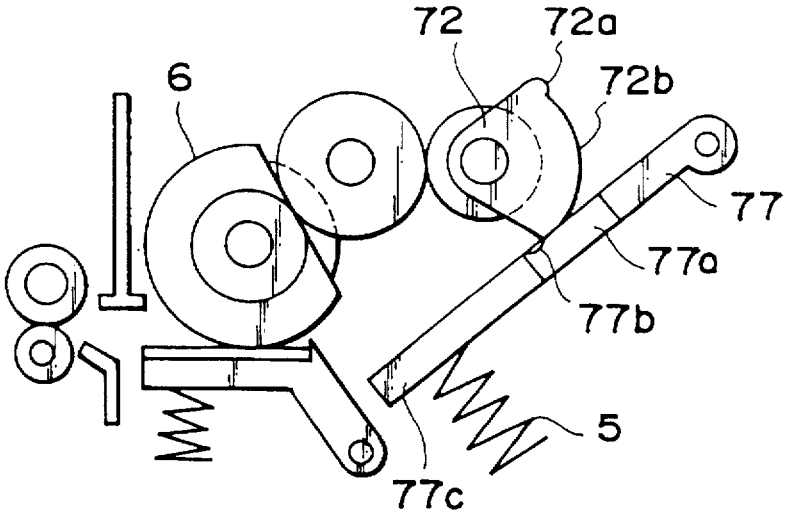

Next, another sheet stacking plate drive mechanism will be explained with reference to FIGS. 11, 12 and 22 to 24. In FIGS. 22 to 24, the same elements as those of FIG. 11 are designated by the same reference numerals.

In FIG. 22, a cam plate 172 having a projection 172*a* and a gear 173 are secured to a common shaft 174, and the gear 173 is rotated by a gear 176 secured to the shaft 107 via gear 175. Since the number of teeth of the gear 173 is the same as the number of teeth of the gear 176, when the sheet supply roller 106 is rotated by one revolution, the cam plate 172 is also rotated by one revolution. A recess 177*b* is provided in a side portion 177*a* of a sheet stacking plate 177 so that, when the sheet supply roller is in a position shown in FIG. 22, the projection 172*a* of the cam plate 172 is engaged by the recess 177*b*.

In this condition, an end 177*c* of the sheet stacking plate 177 is lowered in the lowermost position. With this arrangement, since the engagement position between the cam plate 172 and the sheet stacking plate 177 can be selected or determined by selecting or determining the number of teeth of the gear 175 for driving the cam plate 172, the degrees of freedom in design can be increased.

In FIG. 23, when the cam plate 172 is rotated in synchronism with the rotation of the sheet supply roller 106, the projection 172*a* moves out of an upper surface of the side portion 177*a* of the sheet stacking plate 177, with the result that the sheet stacking plate 177 is lifted by the spring 105, thereby abutting the end 177*c* against the large diameter portion of the sheet supply roller 106.

In FIG. 24, in synchronism with the further rotation of the sheet supply roller 106, when the cam plate 172 is also rotated, since the upper surface of the side portion 177*a* is pushed down by the maximum lift profile 172*b* of the cam plate 172, the sheet stacking plate 177 is lowered. By the further rotation of the sheet supply roller 106, the condition shown in FIG. 22 is restored.

Figure 25:
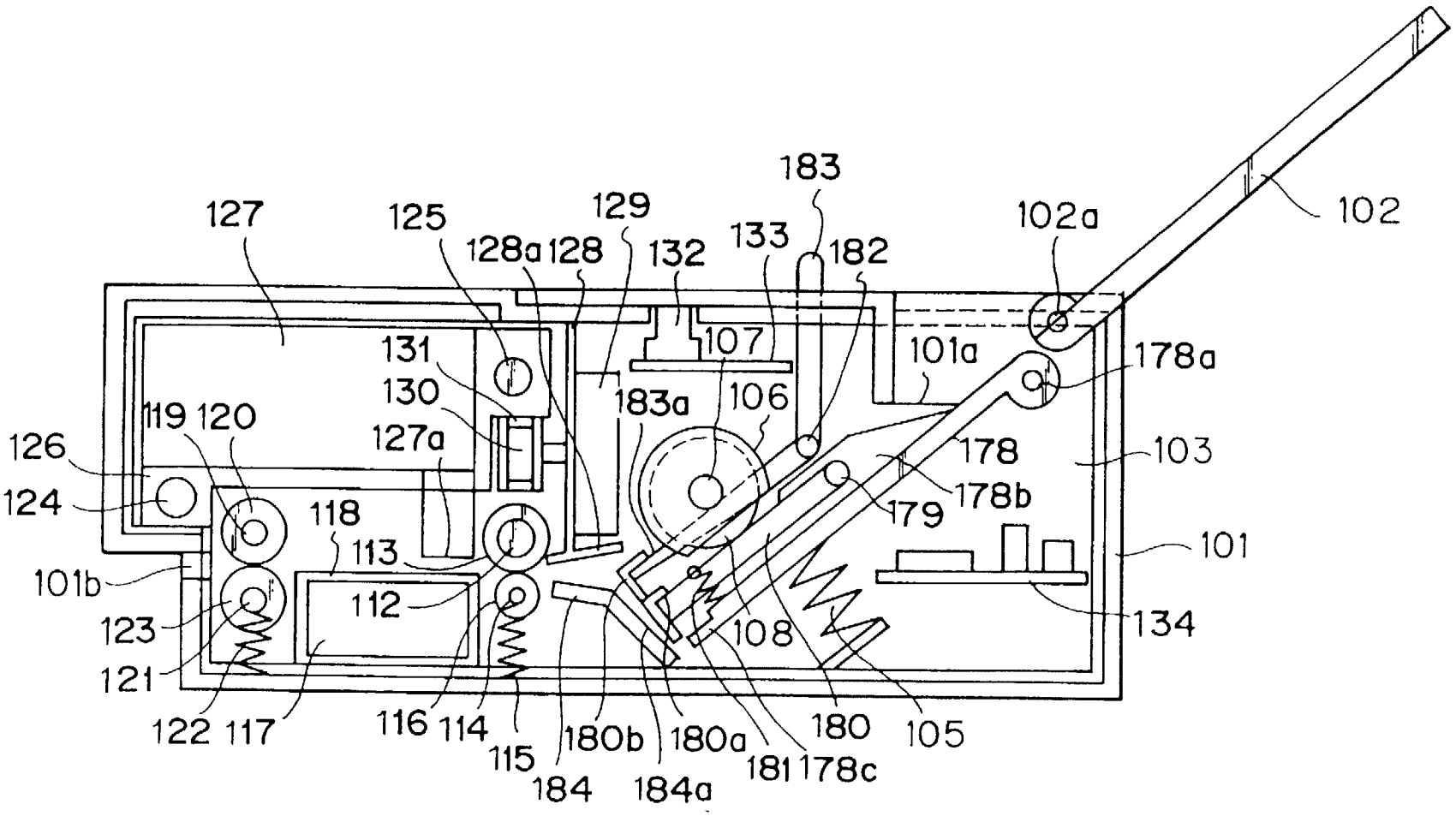
FIG. 25 is a sectional view showing a sixth embodiment of the present invention.

Next, a sixth embodiment of the present invention will be explained with reference to FIGS. 11, 12 and 25. FIG. 25 is a sectional view of a recording apparatus according to a sixth embodiment. In FIG. 25, the same elements as those of FIGS. 11 and 12 are designated by the same reference numerals.

In the fifth embodiment, the sheets are separated one by one by the cooperation of the separation pad and the sheet supply roller. However, in this sixth embodiment, thin sheets are separated one by one by a corner separation pawl, and thick sheets such as post cards, envelopes and the like are separated one by one by a so-called abut separation method wherein the sheets are separated one by one by abutting the sheets against an inclined surface.

In FIG. 25, a pawl member 180 having a pawl portion 180*a* is pivotally mounted, via a rotary shaft 179, on a side plate 178*b* provided at a side of a sheet stacking plate 178 rotatably supported by a shaft 178*a*. The pawl member 180 is always biased by a spring 181 toward the sheet stacking plate 178. A switch lever 183 rotatably mounted on a shaft 182 serves to switch the separation mode between the pawl separation mode and the abut separation mode. A free end 183*a* of the lever 183 is engaged by a hook portion 180*b* provided on the pawl member 180. When the lever 183 is rotated in a clockwise direction, a distance between the pawl portion 180*a* and the sheet stacking plate 178 is increased, so that the sheets can be inserted below the pawl portion 180*a*. The inserted sheets can be separated one by one by the pawl portion 180*a*.

When the lever 183 is rotated in an anti-clockwise direction, since the pawl portion 180*a* is entered into a recessed portion 178*c* formed in the free end of the sheet stacking plate 178 by the action of the spring 181, the sheets can be stacked on the pawl portion 180*a*, and the sheets stacked on the pawl portion 180*a* can be separated one by one by abutting the sheets against an inclined surface 184*a* of an inclined surface member 184. The sheet supply roller 106 having a large diameter portion and a small diameter portion is secured to the shaft 107, and the sheet supply roller 106 supplies a separated sheet toward the main roller 113 by two revolutions. The supplied sheet is pinched between the main roller 113 and the main pinch rollers 116, and is fed to a predetermined position. Since further operation is the same as that explained in connection with FIG. 12, the explanation thereof will be omitted.

Figure 26:
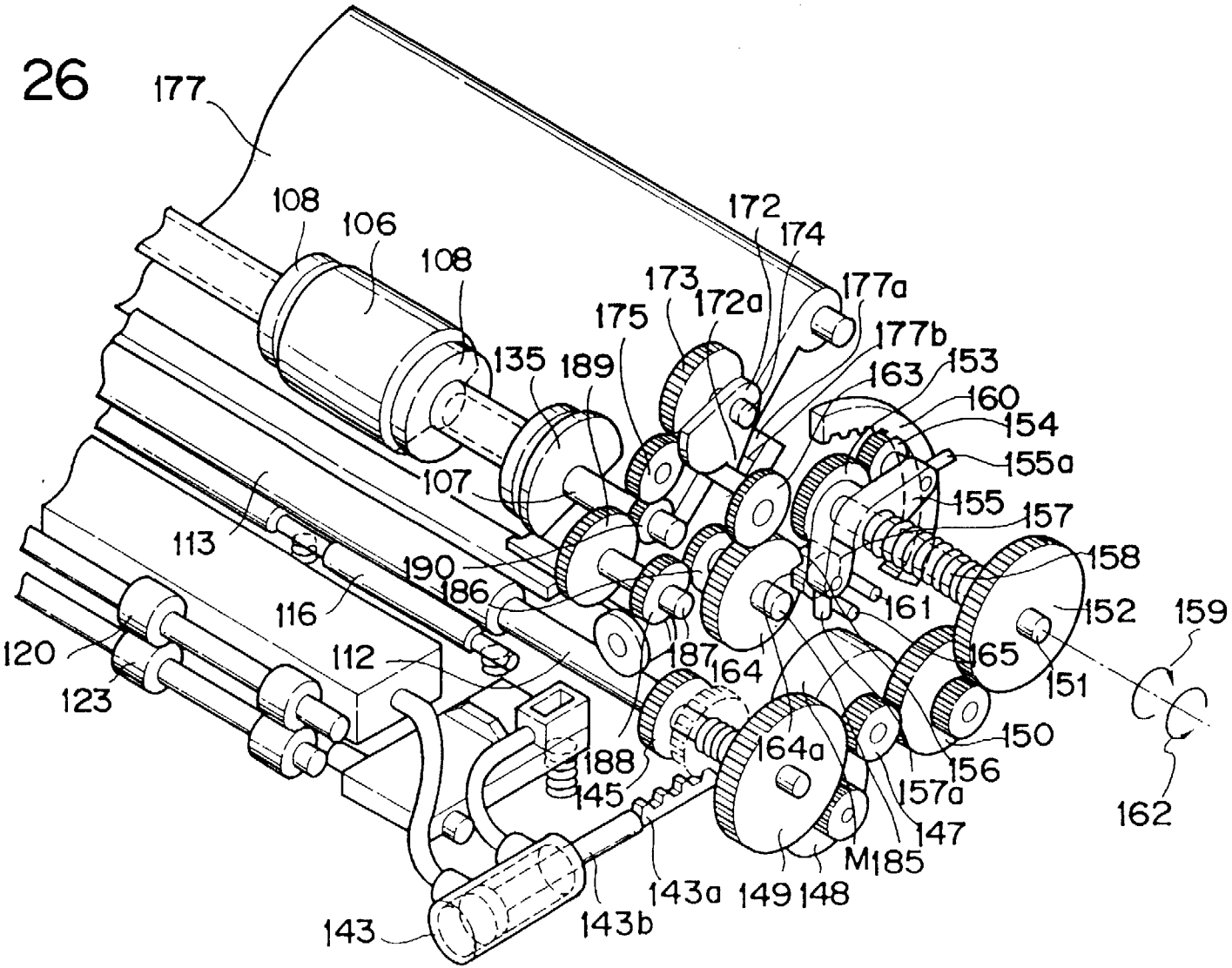
FIG. 26 is a perspective view showing the sixth embodiment of the present invention.
Figure 27:
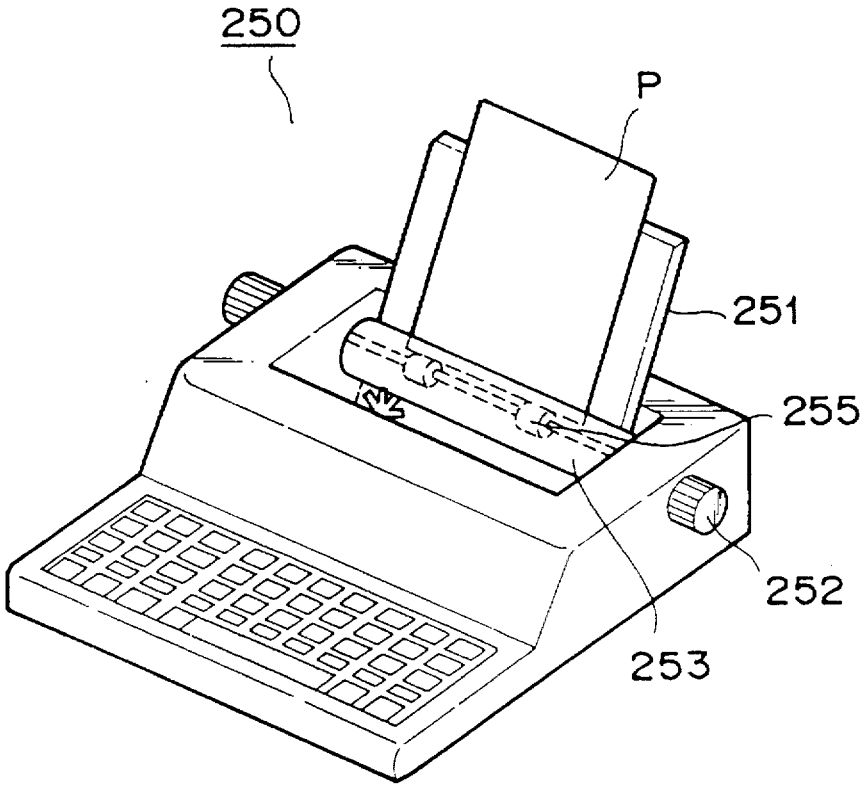
FIG. 27 is a perspective view of a recording apparatus using a conventional sheet convey apparatus.
Figure 28:
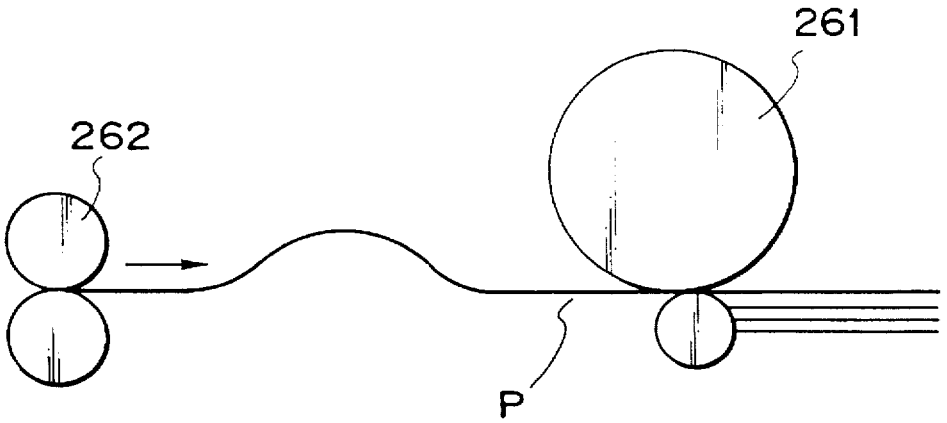
FIG. 28 is a side view showing a main portion of another conventional sheet convey apparatus.

Next, a transmission portion according to the sixth embodiment will be explained with reference to FIGS. 25 and 26. FIG. 26 is a schematic perspective view showing the transmission portion and therearound according to the sixth embodiment, and, in FIG. 26, the same elements as those of FIG. 11 are designated by the same reference numerals used in FIG. 11.

In FIG. 26, when the shaft 151 is rotated in the direction shown by the arrow 159 by the motor M via the gears 150,152, the first planetary gear 154 is revolved in the direction shown by the arrow 159 until the pin 155*a* abuts against the pin 161. On the other hand, the second planetary gear 156 is revolved in the same direction to rotate the notched gear 164 secured to a shaft 185 in the direction shown by the arrow 159 while engaging the notched gear 164. During this rotation, when the notched portion 164*a* reaches the second planetary gear 156, the second planetary gear 156 is rotated idly not to transmit the driving force to notched gear 164.

Then, when the shaft 151 is rotated in the direction shown by the arrow 162 by the motor M, the first planetary gear 154 is rotated while engaging by the inner gear 160 and is further revolved in the direction shown by the arrow 162, and then rotates the notched gear 164 in the direction shown by the arrow 159 while engaging the gear 163. The rotation of the notched gear 164 is transmitted to the sheet supply roller 106 via a gear 186 secured to a shaft 185, a gear 188 secured to a shaft 187 and a gear 189 secured to the shaft 187. Since the number of teeth of the gear 186 is the same as the number of teeth of the gear 188 and the number of teeth of the gear 189 is twice the number of teeth of the gear 190, when the notched gear 164 is rotated by one revolution, the sheet supply roller 106 is rotated by two revolutions in the sheet supply direction.

To the cam plate 172 secured to the shaft 174 and performing the same operation as explained in connection with FIGS. 22 to 24, the rotation of the notched gear 164 is transmitted via the gear 173 secured to the shaft 174, gear 175 and gear 190. Since the number of teeth of the gear 173 is set to be twice the number of teeth of the gear 190, when the sheet supply roller 106 is rotated by two revolutions, the cam plate 172 is rotated by one revolution in the direction shown by the arrow 159 and returned to its original position.

Next, a sheet supply operation according to the sixth embodiment will be explained with reference to FIGS. 25 and 26.

In FIG. 25, when the switch lever 183 is rotated in the clockwise direction, since the pawl 180*a* is separated from the surface of the sheet stacking plate 177, a plurality of sheets are inserted into the space. On the other hand, if thick sheets are used, the lever 183 is rotated in the anti-clockwise direction.

In FIG. 26, when the main roller 113 is rotated to convey a sheet reversely by rotation of the motor M in response to a signal from the controller 134, the gear 152 is rotated in the direction shown by the arrow 162 via the gear 150. From the position where the pin 155*a* of the carrier 155 is abutted against the pin 161 secured to the side plate, the first planetary gear 154 is revolved in the direction shown by the arrow 162 through the non-synchronous movement zone having a predetermined angle to engage the gear 163. By the rotation of the gear 163, the notched gear 164 is also rotated in the direction shown by the arrow 159. The rotation of the notched gear 164 is transmitted to the sheet supply roller 106 via the gears 186, 188, 189, 190, thereby rotating the sheet supply roller 106 in the sheet supply direction. On the other hand, when the cam plate 172 is rotated in the direction shown by the arrow 159 via the gears 190, 175, 173, the projection 172*a* is disengaged from the recess 177*b* of the stacking plate 177, thereby lifting the sheet stacking plate 177 to urge the upper surface of the sheet stack resting on the sheet stacking plate 177 against the sheet supply roller 106.

In this condition, when the uppermost sheet is shifted by the sheet supply roller 106, the tip end of the sheet rides over the pawl portion 180*a* in FIG. 15, and then, the tip end of the sheet is supplied to the contact position between the main roller 113 and the main pinch rollers 116 by the rotation of the sheet supply roller 106. During the plural revolutions of the sheet supply roller 106, when the notched portion 164*a* of the notched gear 164 reaches the gear 163, since the gear 163 is rotated idly, the transmission of the driving force is disconnected to stop the notched gear 164, thereby stopping the sheet supply roller 106.

Then, when the main roller 113 is rotated to feed the sheet normally by the motor M, the sun gear 153 is rotated in the direction shown by the arrow 159, and, in synchronism with this rotation, the first planetary gear 154 is revolved to disengage from the gear 163. On the other hand, in a condition that the pin 157*a* of the carrier 157 is abutted against the pin 165, the second planetary gear 156 is revolved in the direction shown by the arrow 159 to engage the notched gear 164, thereby rotating the notched gear 164 in the direction shown by the arrow 159. By this rotation, since the sheet supply roller 106 is also rotated in the sheet supply direction to shift the sheet, the tip end of the sheet passes through the contact position between the main roller 113 and the main pinch rollers 116 which are being rotated in the normal direction, and then the sheet is conveyed to the predetermined position by the main roller 113.

At the end of the plural revolutions of the sheet supply roller 106, the small diameter portion of the sheet supply roller 106 reaches the sheet surface to separate the sheet supply roller from the sheet, and at the same time, the maximum lift profile of the cam plate 172 pushes down the upper surface of the projection 177*a* of the sheet stacking plate 177, thereby releasing the action for urging the sheet against the sheet supply roller 106.

When the notched portion 164*a* of the notched gear 164 rotated by the second planetary gear 156 reaches the second planetary gear 156, since the second planetary gear 156 is rotated idly to disconnect the transmission of the driving force, the notched gear 164 and the sheet supply roller 106 connected to the notched gear 164 via the gear are stopped. At the stopped position, the projection 172*a* of the cam plate is engaged by the recess 177*b* of the sheet stacking plate again.

In the above-mentioned two embodiments, by using a reading head in place of the recording head, the sheet convey apparatus can easily be applied as an original reading apparatus. Further, by using the pair of main rollers of this apparatus as register rollers of a copying machine, the sheet convey apparatus can easily be applied to a copying machine.

Incidentally, the recording head in the above embodiments is of the ink jet type. The ink jet recording head serves to record characters and the like on the sheet by forming ink droplets corresponding to the record signal by causing a change in condition (including the formation of bubbles) in the ink by utilizing thermal energy.

As mentioned above, according to the present invention, it is possible to convey the sheet in a direction perpendicular to the generatrix of the main roller with high accuracy regardless of the thickness of the sheet (thin sheet, thick sheet or the like), by performing a series of sheet supply operations in which the transmission portion for transmitting the driving force of the output shaft of the motor for driving the main roller to the sheet supply roller having the large and small diameter portions is controlled by a predetermined amount of normal and reverse rotation of the motor, and, during one direction rotation of the motor, the transmission portion drives the sheet supply roller through the predetermined non-synchronous movement process to cause the sheet supply roller to supply a sheet to the pair of main rollers, and then the transmission portion stops the sheet supply roller, and then, during the other direction rotation of the motor, the transmission portion further drives the sheet supply roller to cause the sheet supply roller to pass the sheet through the nip between the pair of main rollers.

Further, since the sheet supply roller can be arranged in the proximity of the main roller, it is possible to make the apparatus small-sized. In addition, since the non-synchronous movement process can be effected by the transmission portion without providing special members and a plurality of mechanisms can be driven by the single motor by providing the non-synchronous movement process, it is possible to provide a sheet convey apparatus which is inexpensive.

What is claimed is:

1. A sheet convey apparatus, comprising:

convey means for conveying a sheet in a convey direction;

a pair of rollers arranged downstream of said convey means in the convey direction for conveying a sheet in the convey direction or in a reverse direction by rotation of said pair of rollers in the convey direction or in the reverse direction; and control means for controlling said convey means and said pair of rollers in such a manner that, after a sheet is conveyed by said pair of rollers in the convey direction by a predetermined amount past a nip between said pair of rollers, said pair of rollers are rotated in the reverse direction while applying a conveying force in the convey direction to the sheet with said convey means, said convey means allowing a part of the sheet which contacts said convey means to shift in the reverse direction when said pair of rollers rotate in the reverse direction, thereby conveying the sheet in the reverse direction until the sheet passes through the nip between said pair of rollers.

2. A sheet convey apparatus according to claim 1, wherein said convey means has a convey roller.

3. A sheet convey apparatus according to claim 2, wherein said convey roller has a spring member for urging said convey roller against the sheet and accumulating the conveying force which is applied to the sheet by said spring member, when said pair of rollers are being rotated in the reverse direction.

4. A sheet convey apparatus according to claim 3, wherein said spring member connects said convey roller to a support shaft and accumulates a force for rotating said convey roller.

5. A sheet convey apparatus according to claim 3, wherein said convey roller is shiftably supported for shifting in said convey direction or in said reverse direction, and said spring member biases said convey roller toward the convey direction.

6. A sheet convey apparatus according to claim 2, wherein, during rotation of said pair of rollers in the reverse direction, said convey roller is rotated in the convey direction while slipping relative to the sheet.

7. A sheet convey apparatus according to claim 1, wherein said pair of rollers is controlled by said control means in such a manner that, after the sheet is conveyed until the sheet passes through the nip between said pair of rollers, said pair of rollers are rotated in the convey direction to convey the sheet in the convey direction.

8. A sheet supply apparatus, comprising:

a supply rotary member for supplying a sheet in a convey direction;

a pair of convey rotary members rotatable in the convey direction or a reverse direction for pinching and conveying a sheet supplied by said supply rotary member in the convey direction when rotated in the convey direction; and control means for controlling said supply rotary member and said pair of convey rotary members in such a manner that said supply rotary member is rotated in the convey direction to supply a sheet in the convey direction, so that a tip end of the sheet is abutted against a nip between said pair of convey rotary members being rotated in the reverse direction, then said supply rotary member is rotated in the convey direction while slipping relative to the sheet after the tip end of the sheet is abutted against said nip, thereby continuing to apply a conveying force to the sheet, and then said pair of convey rotary members are rotated in the convey direction.

9. A sheet supply apparatus according to claim 8, wherein said supply rotary member is separated from the sheet when a supply operation is finished.

10. A sheet supply apparatus, comprising:

supply means for supplying a sheet in a convey direction;

a pair of rollers arranged downstream of said supply means in the convey direction for conveying a sheet in the convey direction or in a reverse direction by rotation of said pair of rollers in the convey direction or in the reverse direction; and control means for controlling said supply means and said pair of rollers in such a manner that said supply means rotates in the convey direction to convey a sheet to be conveyed in the convey direction so that the sheet is abutted against a nip between said pair of rollers being rotated in the reverse direction, then said supply means continues to rotate in the convey direction after abutment of the sheet against the nip between said pair of rollers to transmit a conveying force to the sheet and so that the sheet slips relative to said Supply means, and then said pair of rollers rotate in the convey direction.

11. A sheet supply apparatus according to claim 10, wherein said control means has a drive source, and transmission means for transmitting a driving force from said drive source to said supply means and to said pair of rollers.

12. A sheet supply apparatus according to claim 11, wherein said transmission means has a sun gear, and a planetary gear meshed with said sun gear and meshed with a notched gear connected to said supply means directly or via an idle gear.

13. A sheet supply apparatus according to claim 12, wherein said notched gear connected to said supply means is a notched gear having a non-toothed portion formed on a portion of a peripheral surface of said notched gear.

14. A sheet supply apparatus according to claim 13, wherein said planetary gear or said idle gear transmits the driving force until said planetary gear or said idle gear faces said non-toothed portion of said notched gear.

15. A sheet supply apparatus according to claim 14, wherein said supply means has a supply portion for contacting the sheet and a non-supply portion for not contacting the sheet, and, when said planetary gear faces said non-toothed portion of said notched gear, said non-supply portion of said supply means faces the sheet.

16. A recording apparatus, comprising:

convey means for conveying a sheet in a convey direction;

a pair of rollers arranged downstream of said convey means in said convey direction for conveying a sheet in the convey direction or in a reverse direction by rotation of said pair of rollers in the convey direction or in the reverse direction;

control means for controlling said convey means and said pair of rollers in such a manner that, after a sheet is conveyed by said pair of rollers in the convey direction by a predetermined amount past a nip between said pair of rollers, said pair of rollers are rotated in the reverse direction while applying a conveying force in the convey direction to the sheet by said convey means, said convey means allowing a part of the sheet which contacts said convey means to shift in the reverse direction when said pair of rollers rotate in the reverse direction, thereby conveying the sheet in the reverse direction until the sheet passes through the nip between said pair of rollers; and recording means for recording an image on a sheet conveyed by said pair of rollers.

17. A recording apparatus according to claim 16, wherein said recording means has an ink jet head.

18. A recording apparatus according to claim 17, wherein said ink jet head discharges ink by utilizing thermal energy.

19. A recording apparatus, comprising:

a supply rotary member for supplying a sheet in a convey direction;

a pair of convey rotary members rotatable in a convey direction or a reverse direction for pinching and conveying a sheet supplied by said supply rotary member in the convey direction when rotated in the convey direction;

control means for controlling said supply rotary member and said pair of convey rotary members in such a manner that said supply rotary means is rotated to supply a sheet in the convey direction, so that a tip end of the sheet is abutted against a nip between said pair of convey rotary members being rotated in the reverse direction, then said supply rotary member is rotated in the convey direction while slipping relative to the sheet after the tip end of the sheet is abutted against said nip, thereby continuing to apply a conveying force to the sheet, and then said pair of convey rotary members are rotated in the convey direction; and recording means for recording an image on a sheet conveyed by said pair of convey rollers.

20. A recording apparatus according to claim 19, wherein said recording means has an ink jet head.

21. A recording apparatus according to claim 20, wherein said ink jet head discharges ink by utilizing thermal energy.

22. A recording apparatus, comprising:

supply means for supplying a sheet in a convey direction;

a pair of rollers arranged downstream of said supply means in the convey direction for conveying a sheet in the convey direction or in a reverse direction by rotation of said pair of rollers in the convey direction or in the reverse direction;

control means for controlling said supply means and said pair of rollers in such a manner that said supply means rotates in the convey direction to convey a sheet to be conveyed in the convey direction so that the sheet is abutted against a nip between said pair of rollers being rotated in the reverse direction, then said supply means continues to rotate in the convey direction after abutment of the sheet against the nip between said pair of rollers to transmit a conveying force to the sheet and so that the sheet slips relative to said supply means, and then said pair of rollers rotate in the convey direction; and recording means for recording an image on a sheet conveyed by said pair of rollers.

23. A recording apparatus according to claim 22, wherein said recording means has an ink jet head.

24. A recording apparatus according to claim 23, wherein said ink jet head discharges ink by utilizing thermal energy.

* * * * *

UNITED STATES PATENT AND TRADEMARK OFFICE

CERTIFICATE OF CORRECTION

PATENT NO. : 5,594,486
DATED : January 14, 1997
INVENTOR(S) : Takehiko KIYOHARA

It is certified that error appears in the above-indentified patent and that said Letters Patent is hereby corrected as shown below:

COLUMN 6:
Line 57, "lines" should read --lines--.

COLUMN 7:
Line 65, "a" should be deleted.

COLUMN 16:
Line 48, "160" should read --160,--.

COLUMN 17:
Line 23, "rotated" should read --rotated,--.

COLUMN 24:
Line 13, "Supply" should read --supply--.

COLUMN 26:
Line 17, "rotate" should read --rotates--.

Signed and Sealed this

Twelfth Day of August, 1997

Bruce Lehman

*Attest:*

BRUCE LEHMAN

*Attesting Officer*

*Commissioner of Patents and Trademarks*